US008414098B2

(12) United States Patent
Yoshida

(10) Patent No.: US 8,414,098 B2
(45) Date of Patent: Apr. 9, 2013

(54) IMAGE FORMING DEVICE CALIBRATING RELATIVE TILT OFFSET TO PRINT UPSTREAM NOZZLES FIRST

(75) Inventor: Yasunari Yoshida, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 679 days.

(21) Appl. No.: 12/613,497

(22) Filed: Nov. 5, 2009

(65) Prior Publication Data

US 2010/0110135 A1 May 6, 2010

(30) Foreign Application Priority Data

Nov. 6, 2008 (JP) ..... 2008-285314

(51) Int. Cl.
*B41J 29/36* (2006.01)

(52) U.S. Cl.
USPC ..... 347/14; 347/19; 347/16; 347/37; 347/104

(58) Field of Classification Search ..... None
See application file for complete search history.

(56) References Cited

U.S. PATENT DOCUMENTS

| | | | | |
|---|---|---|---|---|
| 6,454,390 | B1 | 9/2002 | Takahashi et al. | |
| 2002/0097288 | A1 * | 7/2002 | Beauchamp | 347/14 |
| 2005/0046654 | A1 * | 3/2005 | King et al. | 347/16 |
| 2007/0008354 | A1 | 1/2007 | Hayashi et al. | |
| 2007/0008363 | A1 | 1/2007 | Hamasaki et al. | |
| 2007/0024660 | A1 * | 2/2007 | Bailey et al. | 347/19 |
| 2007/0146405 | A1 * | 6/2007 | Yoshida | 347/16 |
| 2007/0291059 | A1 | 12/2007 | Hayashi et al. | |

FOREIGN PATENT DOCUMENTS

| | | | |
|---|---|---|---|
| JP | H08-216456 | A | 8/1996 |
| JP | H11-291470 | A | 10/1999 |
| JP | 2005335343 | A * | 12/2005 |
| JP | 2006-218774 | A1 | 8/2006 |
| JP | 2007038662 | A | 2/2007 |
| JP | 2007-185843 | A | 7/2007 |
| JP | 2008023982 | A | 2/2008 |

OTHER PUBLICATIONS

Machine translation of Katagiri '343 JP publication.*
Japan Patent Office, Office Action for Japanese Patent Application No. 2008-285314 (counterpart to above-captioned patent application), mailed Aug. 17, 2010.

* cited by examiner

*Primary Examiner* — Ryan Lepisto
*Assistant Examiner* — Andrew Jordan
(74) *Attorney, Agent, or Firm* — Baker Botts L.L.P.

(57) ABSTRACT

In an image forming device, the print head performs a bi-directional printing including a first print while being moved in the first direction and a second print while being moved in the second direction. The conveying mechanism conveys the recording medium a first amount prior to the first print and a second amount prior to the second print. The relative tilt offset amount indicates an offset between tilts of the print head when the print head is moved in the first direction and when the print head is moved in the second direction. The tilt calibration value is determined based on the relative tilt offset amount. The conveying amount setting unit sets the first amount to a calibrated amount obtained by calibrating a prescribed amount based the relative tilt offset amount or the relative tilt calibration value prior to the first print and that sets the second amount to the prescribed amount prior to the second print.

9 Claims, 13 Drawing Sheets

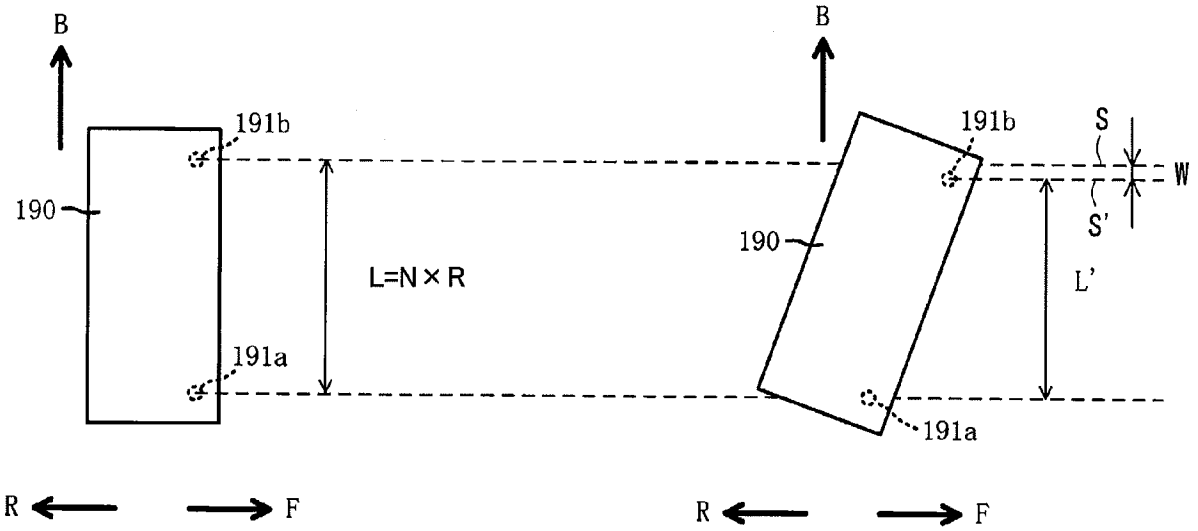
FIG.3(a)
FIG.3(b)
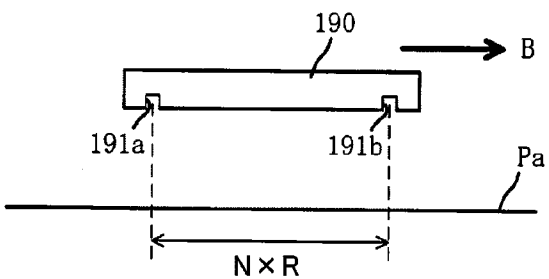
FIG.3(c)
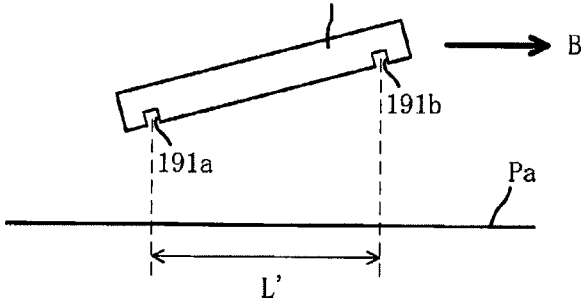
FIG.3(d)

IMAGE FORMING DEVICE CALIBRATING RELATIVE TILT OFFSET TO PRINT UPSTREAM NOZZLES FIRST

CROSS REFERENCE TO RELATED APPLICATION

This application claims priority from Japanese Patent Application No. 2008-285314 filed on Nov. 6, 2008. The entire content of the priority application is incorporated herein by reference.

TECHNICAL FIELD

The present invention relates to an image forming device that performs bi-directional printing.

BACKGROUND

In a bi-directional printing operation, a print head reciprocated in a main scanning direction prints (i.e., ejects ink) while moving in both forward and reverse directions. In the following description, print performed by the print head while moving in the forward direction will be referred to as "forward print", and print performed while moving in the reverse direction will be referred to as "reverse print". In other words, the print head performs the forward print and the reverse print while reciprocatingly moving in the main scanning direction.

In such bi-directional printing operations, printing positions on a recording paper at which ink is ejected in the forward print and the reverse print may be offset from each other with respect to the main scanning direction. For example, when forming a vertical ruled line along a sub-scanning direction, a phenomenon called "ruled line offset" may occur in which the position of the ruled line formed in the forward print is offset in the main scanning direction from the position of the ruled line formed in the reverse print.

A method for aligning the printing positions in this type of situation has been proposed. This method finds a parameter indicating the printing positions in the forward and reverse directions that are most closely aligned and sets a printing start timing for printing in the reverse direction based on the parameter in order to reduce the occurrence of ruled line offset.

At the same time, there is market demand for inexpensive printers. Most manufacturers are able to offer low-cost printers by keeping down the costs of the mechanical structure therein. However, when using an inexpensive mechanical structure in a printer, the print head may tilt with respect to the sub-scanning direction during a bi-directional printing operation at different angle, depending on whether the print head is being conveyed in the forward direction or the reverse direction, resulting in a decline in image quality.

SUMMARY

In view of the foregoing, it is an object of the invention to provide an image forming device, a control method, and a control program capable of preventing a decline in image quality caused by tilting of a recording head with respect to a paper-conveying direction when the recording head is reciprocated during bi-directional recording.

In order to attain the above and other objects, the invention provides an image forming device. The image forming device includes a print head, a head moving mechanism, a conveying mechanism, a first memory, and a conveying amount setting unit. The print head is formed with a plurality of print elements for forming an image on a recording medium. The print elements includes a downstream element and an upstream element positioned upstream of the downstream element in a conveying direction. The head moving mechanism reciprocatingly moves the print head in a first direction and a second direction opposite to the first direction. Both the first direction and the second direction are orthogonal to the conveying direction, and the print head performs a bi-directional printing including a first print for forming a first image while being moved in the first direction and a second print for forming a second image while being moved in the second direction. The conveying mechanism conveys the recording medium toward a downstream side in the conveying direction relative to the print head a first amount prior to the first print and a second amount prior to the second print. The first memory stores one of a relative tilt offset amount and a tilt calibration value. The relative tilt offset amount indicates an offset between tilt of the print head relative to the conveying direction when the head moving mechanism conveys the print head in the first direction and tilt of the print head relative to the conveying direction when the head moving mechanism moves the print head in the second direction. The tilt calibration value is determined based on the relative tilt offset amount. The conveying amount setting unit sets the first amount to a calibrated amount that is obtained by calibrating a prescribed amount based on the one of the relative tilt offset amount and the relative tilt calibration value prior to the first print and that sets the second amount to the prescribed amount prior to the second print.

According to another aspect, the invention provides a method for controlling an image forming device. The image forming device includes a print head and a first memory. The print head is formed with a plurality of print elements for forming an image on a recording medium. The print head performs a bi-directional printing including a first print for forming a first image while being moved in a first direction and a second print for forming a second image while being moved in a second direction opposite to the first direction. The first memory stores one of a relative tilt offset amount and a tilt calibration value. The relative tilt offset amount indicates an offset between tilt of the print head relative to a conveying direction when the print head is moved in the first direction and tilt of the print head relative to the conveying direction when the print head is moved in the second direction. The tilt calibration value is determined based on the relative tilt offset amount. The conveying direction is orthogonal to the first and second directions. The method includes performing a first control: and performing a second control. The first control includes setting a first amount to a calibrated amount that is obtained by calibrating a prescribed amount based on the one of the relative tilt offset amount and the relative tilt calibration value, conveying the recording medium the first amount in the conveying direction, and performing the first print. The second control includes setting a second amount to the prescribed amount, conveying the recording medium in the conveying direction the second amount, and performing the second print.

According to still another aspect, the invention provides a storage medium storing a set of program instructions executable on a data processing device and usable for controlling an image forming. The image forming device includes a print head and a first memory. The print head is formed with a plurality of print elements for forming an image on a recording medium. The print head performs a bi-directional printing including a first print for forming a first image while being moved in a first direction and a second print for forming a second image while being moved in a second direction opposite to the first direction. The first memory stores one of a relative tilt offset amount and a tilt calibration value. The relative tilt offset amount indicates an offset between tilt of the print head relative to a conveying direction when the print head is moved in the first direction and tilt of the print head relative to the conveying direction when the print head is moved in the second direction. The tilt calibration value is determined based on the relative tilt offset amount. The conveying direction is orthogonal to the first and second directions. The program instructions include performing a first control: and performing a second control. The first control includes setting a first amount to a calibrated amount that is obtained by calibrating a prescribed amount based on the one of the relative tilt offset amount and the relative tilt calibration value, conveying the recording medium the first amount in the conveying direction, and performing the first print. The second control includes setting a second amount to the prescribed amount, conveying the recording medium in the conveying direction the second amount, and performing the second print.

BRIEF DESCRIPTION OF THE DRAWINGS

The particular features and advantages of the invention as well as other objects will become apparent from the following description taken in connection with the accompanying drawings, in which:

FIG. 2(*b*) is a side view of the convey unit shown in FIG. 2(*a*);

FIG. 3(*a*) is an explanatory plan view of the print head not tilted with respect to a paper-conveying direction;

FIG. 3(*b*) is an explanatory plan view of the print head tilted with respect to the paper-conveying direction;

FIG. 3(*c*) is an explanatory side view of a print head of the printer not tilted with respect to the paper-conveying direction;

FIG. 3(*d*) is an explanatory side view of the print head tilted upward with respect to the paper-conveying direction;

FIG. 4(*b*) is a view conceptually illustrating printing results obtained when the print head is not tilted with respect to the paper-conveying direction in a forward print but is tilted in a reverse print;

FIG. 5(*b*) is a flowchart illustrating steps in a tilt calibration value acquisition process executed by the printer;

FIG. 7(*b*) is a flowchart illustrating steps in a conveying distance calibration value acquisition process executed by the printer;

FIG. 10(*b*) is a view conceptually illustrating printing results according to the normal printing process shown in FIG. 9;

FIG. 13(*b*) conceptually illustrates printing results for overlap printing when the printing position for a forward print is downstream of the printing position for a reverse print in the paper-conveying direction.

DETAILED DESCRIPTION

An image forming device according to an embodiment of the invention will be described while referring to the accompanying drawings. This embodiment pertains to a printer 1 shown in FIG. 1. The term "below" and the like will be used throughout the description assuming that the printer 1 is disposed in an orientation in which it is intended to be used.

Figure 1:
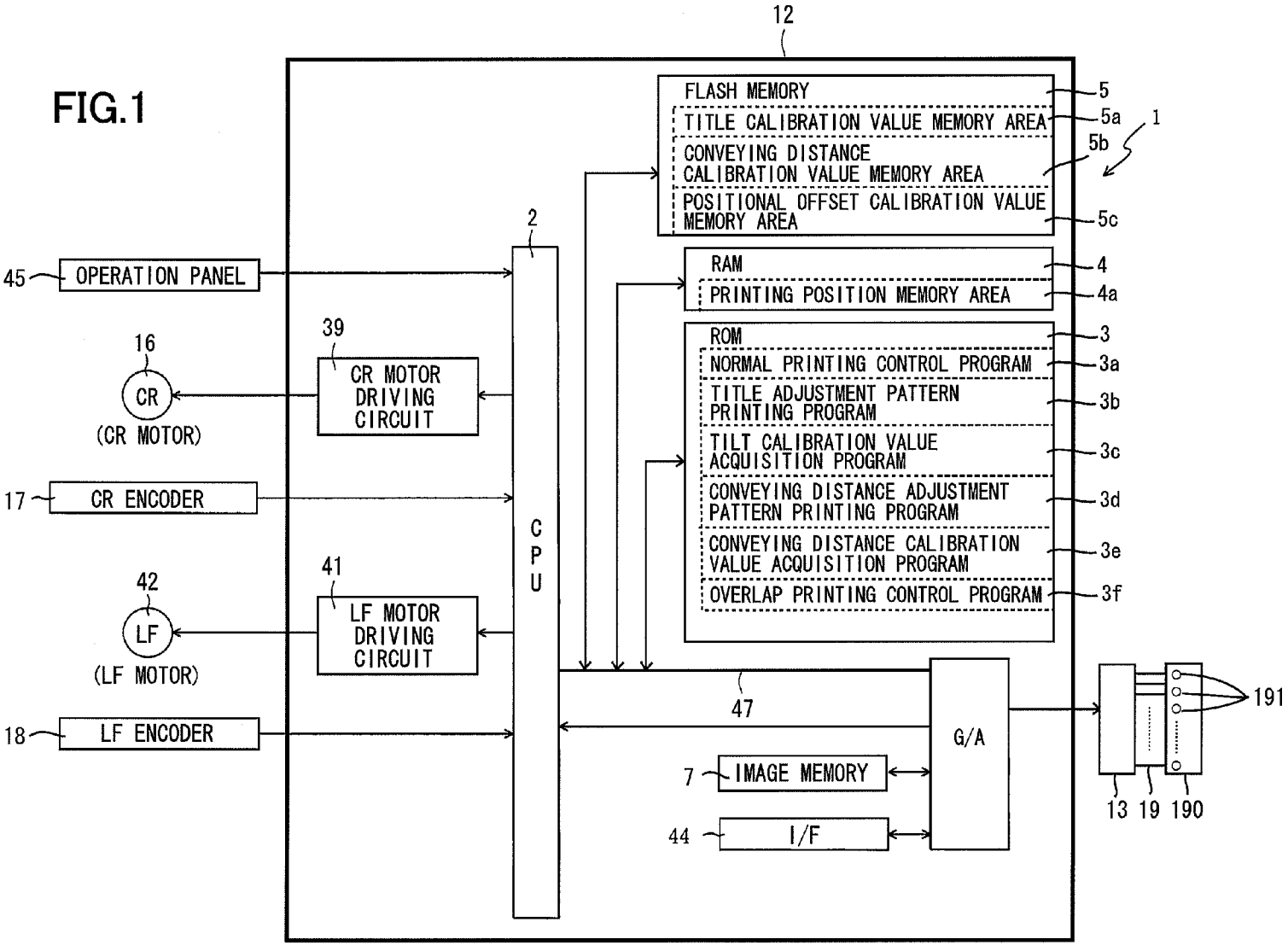
FIG. 1 is a block diagram illustrating an electrical circuit of a printer according to an embodiment of the invention.

The printer 1 is an inkjet printer that performs bi-directional printing for forming color images on a recording paper by ejecting ink of different colors from a print head 190 shown in FIG. 1.

As shown in FIG. 1, the printer 1 includes a control board 12 and a carriage board 13, together function as a control device. The control board 12 includes a CPU 2, a ROM 3, a RAM 4, a flash memory 5, an image memory 7, a gate array (G/A) 6, and an interface (I/F) 44. The ROM 3, the RAM 4, the flash memory 5, and the gate array 6 are connected to the CPU 2 via a bus line 47.

The CPU 2 executes various processes based on the control programs stored in the ROM 3. For example, based on the control programs, the CPU 2 processes input image data and stores the processed image data into the image memory 7, or the CPU 2 generates print timing signals and transfers the same to the gate array 6.

The CPU 2 is connected to and controls an operation panel 45 on which a user inputs various command. The CPU 2 is also connected to and controls a carriage (CR) motor driving circuit 39, a CR encoder 17, a line feed (LF) motor driving circuit 41, and a LF encoder 18.

The CR motor driving circuit 39 is connected to a CR motor 16 for driving the same. The CR motor 16 is for reciprocatingly moving a carriage 60 (see FIG. 2(*a*)) in the main scanning direction (a forward direction F and a reverse direction R (see FIG. 10(*a*)). The carriage 60 mounts the print head 190 thereon. In other wards, the CR motor 16 moves the print head 190 via the carriage 60 selectively in the forward direction F and the reverse direction R. That is, the print head 190 in a forward print and in a reverse print forms images on the recording paper while moving both in a forward direction F and a reverse direction R.

Figure 2A:
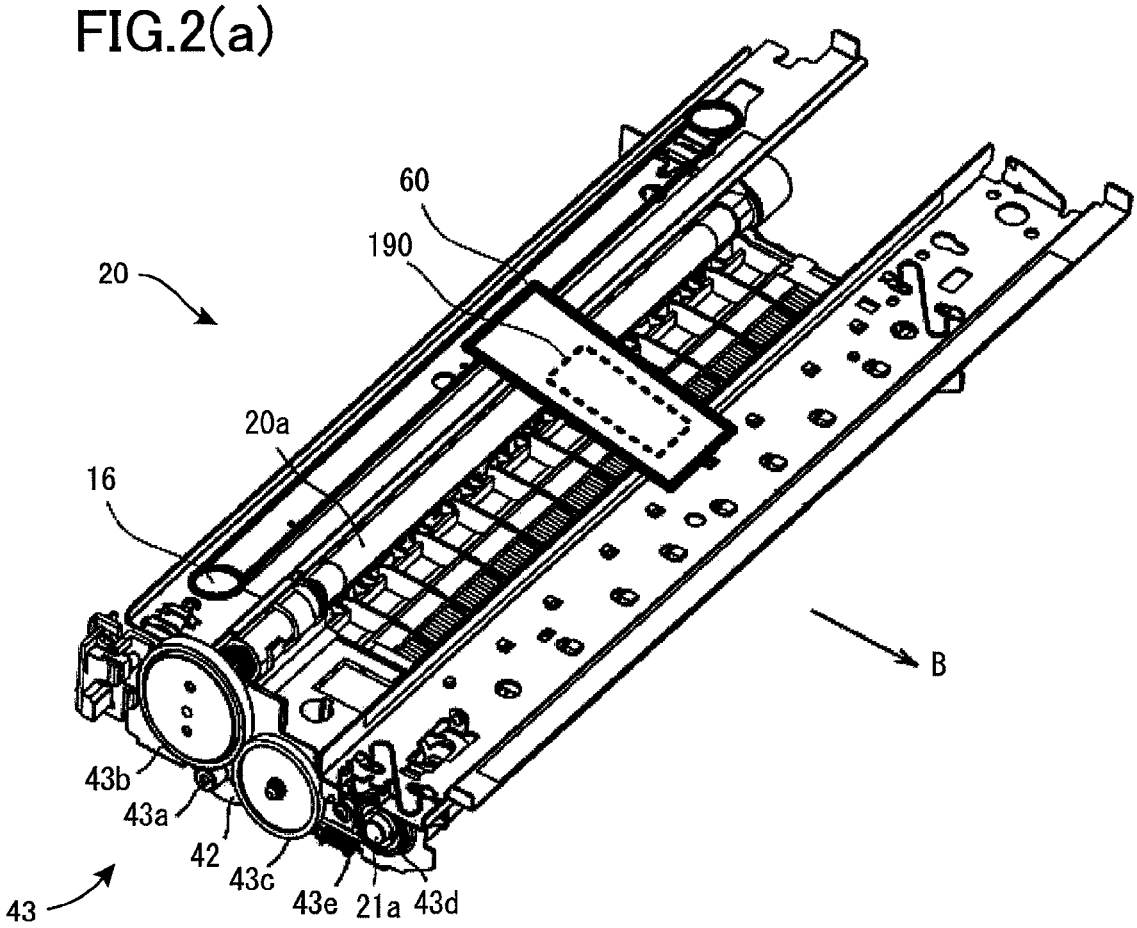
FIG. 2(*a*) is a perspective diagram of a convey unit of the printer.
Figure 2B:
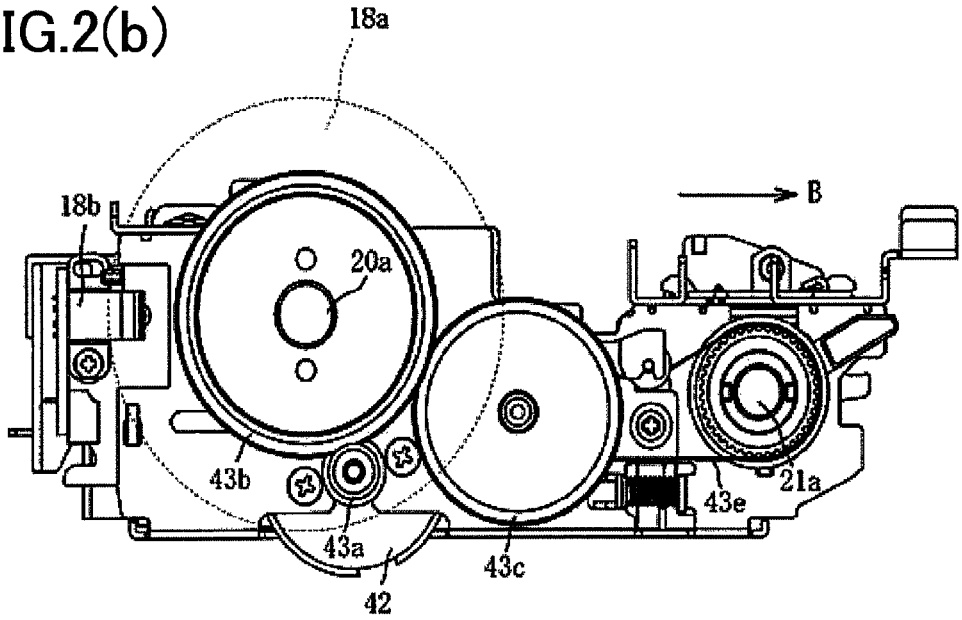

The LF motor driving circuit 41 is connected to and controls a LF motor 42, which in turn drives a convey roller 20*a* (FIG. 2(*a*)) to rotate. The convey roller 20*a* is for conveying a recording paper in a paper-conveying direction B (FIG. 2(*a*)), which is a sub-scanning direction orthogonal to the main scanning direction.

The CR encoder 17 is a linear encoder for detecting a moving amount of the carriage 60. Based on the moving amount detected by the CR encoder 17, the reciprocal movement of the carriage 60 in the main scanning direction is controlled.

The LF encoder 18 is a rotary encoder for detecting a rotating amount of the convey roller 20*a* (FIG. 2(*a*)), and the convey roller 20*a* is controlled based on the rotating amount detected by the LF encoder 18.

The ROM 3 stores various control programs including a normal printing control program 3*a*, a tilt adjustment pattern printing program 3*b*, a tilt calibration value acquisition program 3*c*, a conveying distance adjustment pattern printing program 3*d*, a conveying distance calibration value acquisition program 3*e*, and an overlap printing control program 3*f* and also stores fixed value data. The RAM 4 is for temporarily storing various types of data. The RAM 4 has a printing position memory area 4*a* for storing a printing position.

The flash memory 5 has a tilt calibration value memory area 5*a* for storing a tilt calibration value, a conveying distance calibration value memory area 5*b* for storing a conveying distance calibration value, and a positional offset calibration value memory area 5*c* for storing a positional offset calibration value for correcting offset in the paper-conveying direction B between the printing position of the nozzle 191*b* during a forward print and the printing.

The gate array 6 is for transferring, based on the print timing signals transferred from the CPU 2 and image data stored in the image memory 7, print data (a drive signal) and other signals, such as transfer clock, in synchronization with the print data to the carriage circuit board 13. The gate array 6 also stores image data received via a USB or other interface 44 from a personal computer, digital camera, or the like into the image memory 7.

The carriage circuit board 13 includes a head driver (drive circuit; not shown). The head driver is connected to piezoelectric actuators for each nozzle 191 formed in the print head 190 by a flexible circuit board 19 configured of a copper foil wiring pattern formed on polyimide film having a thickness of 50-150 μm. The CPU 2 controls the head driver through the gate array 6 to apply drive voltages to each piezoelectric actuator as needed. The drive voltages cause ink of a prescribed amount to be ejected from the print head 190 toward a recording paper positioned beneath the print head 190.

The print head 190 has a row of nozzles 191 formed in a bottom surface thereof (the surface that opposes the recording paper) for each of ink colors, such as cyan, magenta, yellow, blue, and black. The nozzles 191 in each row are aligned in the sub-scanning direction at a prescribed nozzle pitch. Each row of nozzles 191 corresponding to a color of ink may be arranged linearly or in a staggered formation. Further, one or a plurality of rows of nozzles 191 may be provided for each color of ink, and the number of rows may be set as needed for each color. As shown in FIGS. 3(*a*) and 3(*b*), a nozzle 191*a* and a nozzle 191*b* belong to a row of nozzles aligned in the sub-scanning direction of the print head 190 (the row of nozzles in the sub-scanning direction for ejecting black ink, for example). The nozzle 191*a* is formed farthest upstream in the paper-conveying direction B, and the nozzle 191*b* farthest downstream.

Ink cartridges (not shown) storing ink in each color are connected to each of the nozzles 191 in the print head 190 via ink channels (not shown) and supply ink thereto.

The printer 1 further includes a convey unit 20 shown in FIG. 2(*a*) for conveying a recording paper. The convey unit 20 includes the convey roller 20*a*, a discharge droller 21*a*, the LF motor 42, and a transmitting mechanism 43. The LF motor 42 is rotatable both in a forward direction and a reverse direction.

The transmitting mechanism 43 is for transmitting driving force from the LF motor 42 to the convey roller 20*a* and the discharge droller 21*a*. The transmitting mechanism 43 includes a pinion 43*a* attached to a drive shaft (not shown) of the LF motor 42, a transmission gear 43*b* engaged with the pinion 43*a*, an intermediate gear 43*c* engaged with the transmission gear 43*b*, a discharge gear 43*d*, and a transmission belt 43*e* wound around and extending between the intermediate gear 43*c* and the discharge gear 43*d*. The transmission gear 43*b* is mounted on the left end of the convey roller 20*a*, and the discharge gear 43*d* is mounted on the left end of the discharge roller 21*a*.

Although not shown in the drawings, the convey roller 20*a* opposes a pinch roller and pinches a recording paper therebetween, and the discharge roller 21*a* opposes another pinch roller and pinches the recording paper therebetween. When driven in the forward rotation, the LF motor 42 drives the convey roller 20*a* and the discharge roller 21*a* to rotate, and the convey roller 20*a* and the discharge roller 21*a* convey the recording paper downstream in the paper-conveying direction B.

The LF encoder 18 has a slitted rotating plate 18*a* that is mounted in a position indicated by a dotted line in FIG. 2(*b*). The slitted rotating plate 18*a* has slits formed at prescribed intervals along its circumference. The LF encoder 18 detects the number of slits in the slitted rotating plate 18*a* that pass a photosensor 18*b* (equivalent to the rotational distance of the convey roller 20*a*) and outputs a pulse signal corresponding to the rotational distance of the convey roller 20*a*. As shown in FIG. 2(*b*), the slitted rotating plate 18*a* rotates coaxially with the convey roller 20*a* in this embodiment.

The CPU 2 generates a control signal based on a bias between the rotational distance of the convey roller 20*a* detected by the LF encoder 18 and a target rotational distance and controls the LF motor 42 through feedback based on the control signal in order to rotate the convey roller 20*a* a distance to compensate for the bias from the target rotational distance. Consequently, the recording paper can be conveyed the desired conveying distance to a target position.

In a normal state, the print head 190 is not tilted relative to the paper-conveying direction B, as shown in FIGS. 3(*a*) and 3(*c*). In this state, a length L in the paper-conveying direction B for a printing region covered during one pass of the print head 190 is equivalent to the product of the number of nozzles N aligned in the sub-scanning direction and the nozzle pitch R of the print head 190. However, when the print head 190 is tilted from the paper-conveying direction B in the main scanning direction (equivalent to the forward direction F or the reverse direction R), as illustrated in FIG. 3(*b*), or is tilted from the paper-conveying direction B vertically, as illustrated in FIG. 3(*c*), the printing region formed in a single pass of a reverse print has a length L' in the paper-conveying direction B that is shorter than the length L by a length W. In other words, in the examples shown in FIGS. 3(*a*)-3(*d*), an offset W is produced between a printing position S' for the nozzle 191*b* when the print head 190 is tilted and a printing position S when the print head 190 is not tilted. Hereinafter, offset in the paper-conveying direction B between a printing position of a nozzle 191 in a forward print and that in a reverse print will be referred to as "positional offset".

Thus, the length of the printing region covered in a single pass of the print head 190 grows shorter as the print head 190 is tilted more relative to the paper-conveying direction B. The printing results will be adversely affected if there is offset between the degree of tilt in the print head 190 relative to the paper-conveying direction B when performing a forward print and tilt in the print head 190 when performing a reverse print (hereinafter referred to as "relative tilt offset").

Figure 4A:
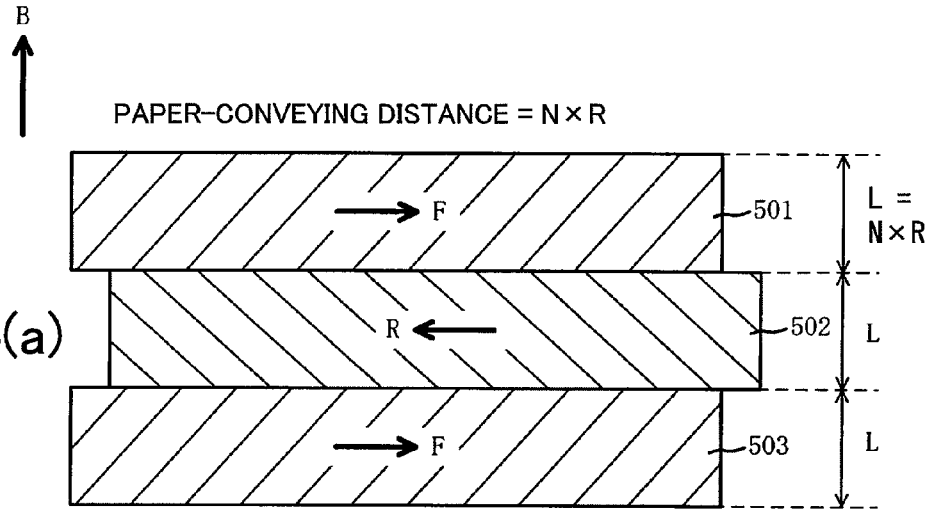
FIG. 4(*a*) is a view conceptually illustrating ideal printing results.
Figure 4B:
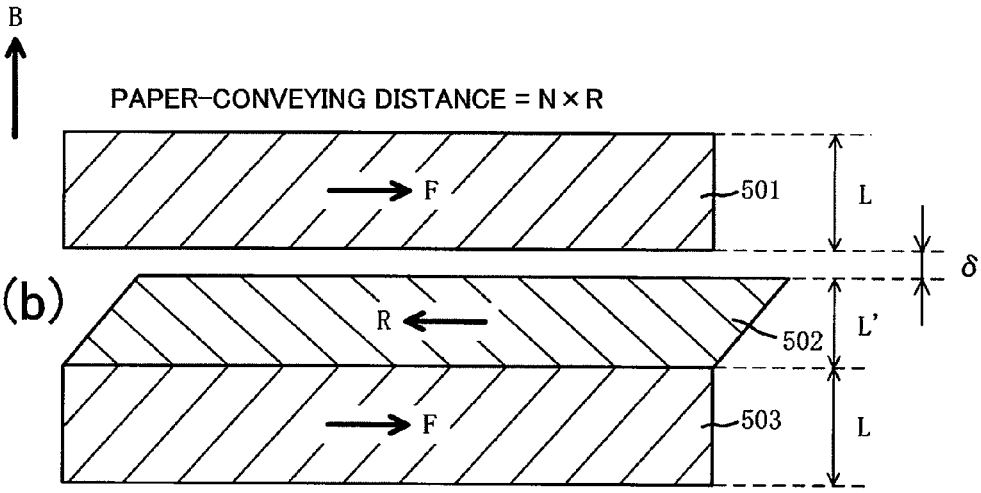

Specifically, printing results such as those shown in FIG. 4(*a*) are obtained when the print head 190 is not tilted relative to the paper-conveying direction B in either a forward print or a reverse print. However, if the print head 190 is tilted in a reverse print while not tilted in a forward print, the length of the printing region covered in the reverse print relative to the paper-conveying direction B is shorter than that covered in a forward print, producing printing results such as those shown in FIG. 4(*b*).

In other words, a gap with a width 8 is produced between a printing region 501 covered in the forward print and a printing region 502 covered in the reverse print. This gap produces a white line with a width 8 that reduces the quality of the image.

The printer 1 according to the embodiment performs a tilt adjustment pattern printing process to find the amount of relative tilt offset.

Next, a method will be described for finding a tilt calibration value. The tilt calibration value is for correcting printing position problems caused by the relative tilt offset. In other words, the relative tilt offset causes a difference between a length of the print head 190 in the paper-conveying direction B in the forward print and a length of the print head 190 in the paper-conveying direction B in the reverse print. The tilt calibration value is for calibrating the difference. Here, the paper-conveying direction B denotes the direction in which a sheet of recording paper to be printed is conveyed from a print starting position to a print ending position. The upstream end of the sheet relative to the paper-conveying direction B is the end on which the last print is performed, while the downstream end of the sheet is the end on which the first print is performed.

Figure 5A:
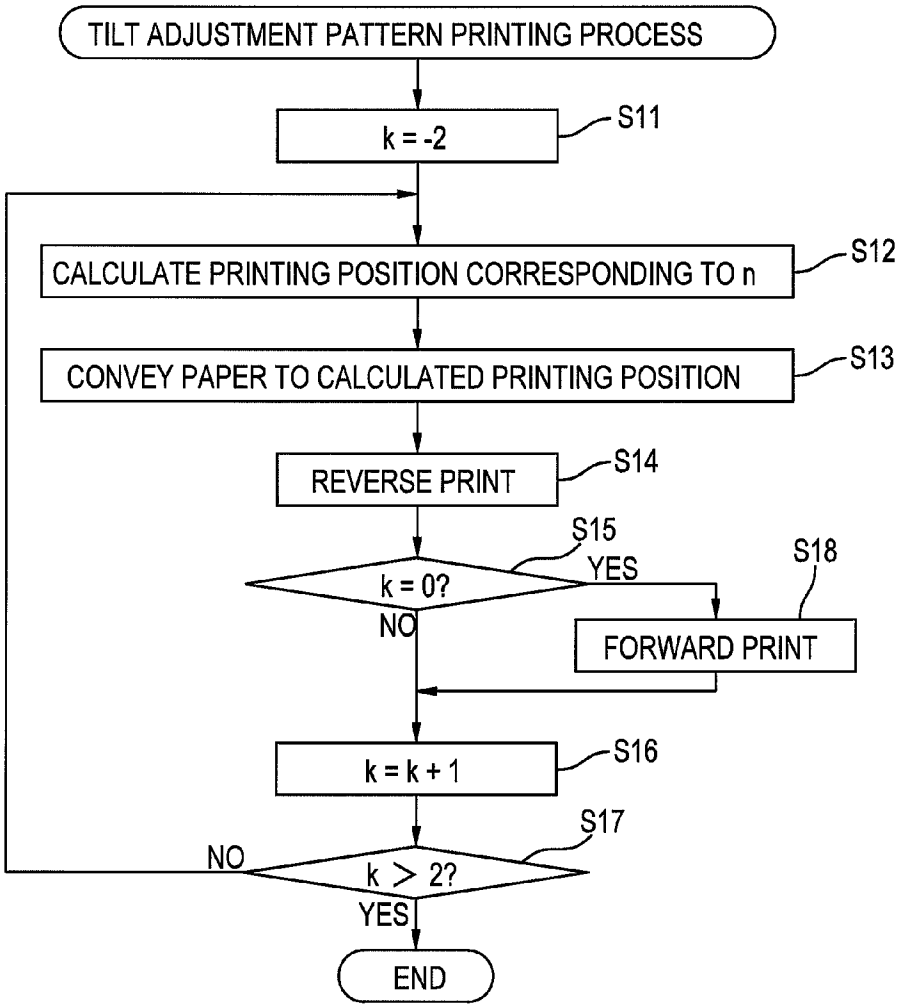
FIG. 5(*a*) is a flowchart illustrating steps in a tilt adjustment pattern printing process executed by the printer.
Figure 5B:
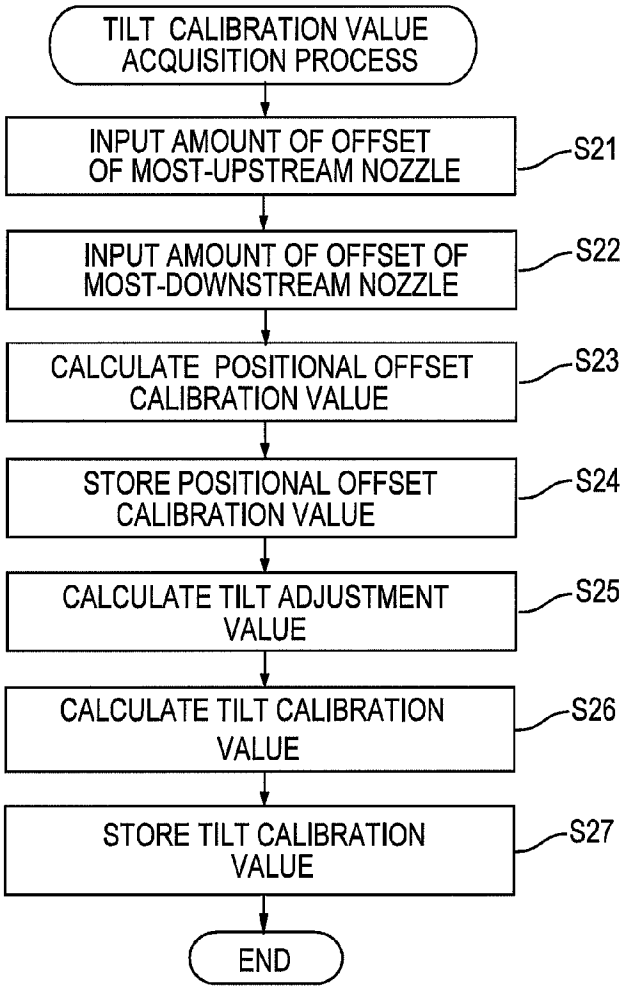

FIG. 5(*a*) is a flowchart illustrating steps in the tilt adjustment pattern printing process executed by the CPU 2. FIG. 5(*b*) is a flowchart illustrating steps in the tilt calibration value acquisition process executed by the CPU 2.

In the embodiment, the manufacturer of the printer 1 executes the tilt adjustment pattern printing process described in FIG. 5(*a*) and the tilt calibration value acquisition process described in FIG. 5(*b*) through prescribed operations prior to shipping the product. The tilt adjustment pattern printing process is executed to print prescribed adjustment patterns. Based on the printed results, the manufacturer can discern whether the print head 190 deviates in the sub-scanning direction when conveyed in the main scanning direction and acquires amounts of offset for the nozzles 191*a*, 191*b*. The tilt calibration value is acquired in the tilt calibration value acquisition process described in FIG. 5(*b*) based on the amounts of offset.

Figure 6:
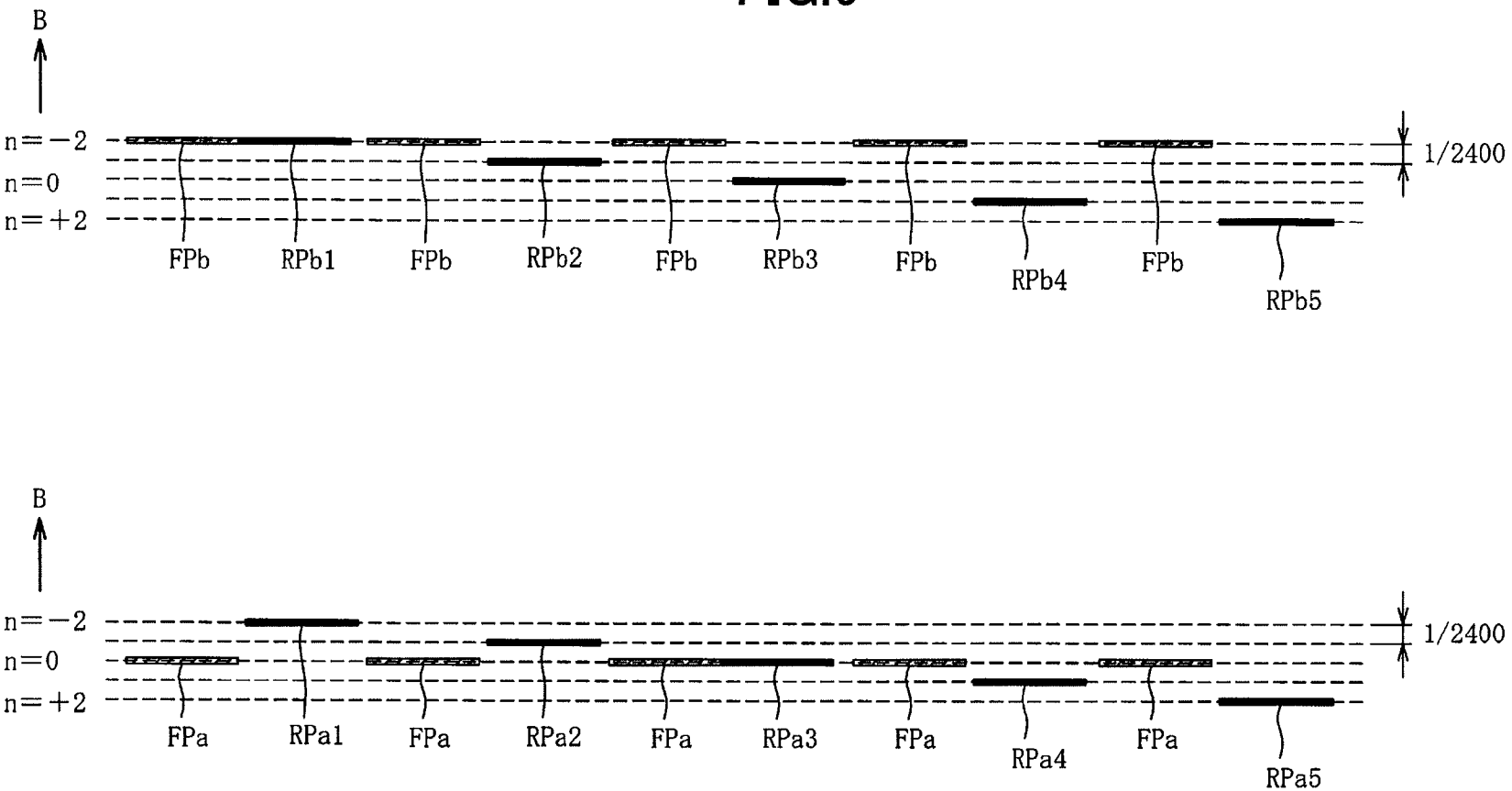
FIG. 6 is a view conceptually illustrating printing results obtained by the tilt calibration value acquisition process.

The tilt adjustment pattern printing process is executed by the CPU 2 based on the tilt adjustment pattern printing program 3*b* stored in the ROM 3. In the tilt adjustment pattern printing process, a pair of adjustment patterns RPa and RPb shown in FIG. 6 is printed by reverse print each time the recording medium is conveyed one unit. Specifically, adjustment patterns RP1-RP5 are sequentially formed at printing positions on the recording paper corresponding to k=−2 to k=+2. Further, when the variable k is 0, a pair of adjustment patterns FPa and FPb is printed by forward print.

More specifically, at first, in S11 of the tilt adjustment pattern printing process shown in FIG. 5(*a*), the CPU 2 initializes the variable k to −2. In S12 the CPU 2 calculates the printing position corresponding to the value of the variable k, and in S13 conveys the recording paper to the printing position. In S14, as shown in FIG. 6, the CPU 2 moves the print head 190 (and more specifically the carriage 60 supporting the print head 190) to a reverse print starting position and controls the nozzles 191*a* and 191*b* to print the adjustment patterns RPa and RPb (one of RPa1-Pra5 and one of RPb1-PRb5), respectively, for the current value of the variable k in a reverse print.

In S15, the CPU 2 determines whether the value of the variable k is 0. If not (S15: NO), the CPU 2 advances to S16. However, if so (S15: YES), then in S18, the CPU 2 prints the adjustment patterns FPa and FPb (see FIG. 6(*a*)) by forward print using the same nozzles 191*a* and 191*b*, respectively, and subsequently advances to S16. Because the print head 190 is moved to the reverse print starting position immediately after the forward print in S18, it is not necessary to convey the print head 190 to the reverse print starting in S14 when k=+1.

In S16, the CPU 2 increments the value of the variable k by 1. Then, in S17, the CPU 2 determines whether or not the value of the variable k is greater than 2. If not (S17:NO), then the CPU 2 returns to S12.

However, if the CPU 2 determines that the value of the variable k is greater than 2 (S17: YES), the CPU 2 ends the tilt adjustment pattern printing process. Printing results such as those shown in FIG. 6 described later are obtained by executing this tilt adjustment pattern printing process. As will be described later in greater detail, the manufacturer finds the amount of positional offset for each of the nozzles 191*a* and 191*b* based on the printing results obtained above.

After completing the tilt adjustment pattern printing process described above, the manufacturer performs a prescribed operation to initiate the tilt calibration value acquisition process shown in FIG. 5(*b*) on the printer 1. This process is also performed in the factory prior to shipping the product based on the tilt calibration value acquisition program 3*e*.

At the beginning of the tilt calibration value acquisition process, in S21 the manufacturer inputs the amount of positional offset for the nozzle 191*a*, and in S22 inputs the amount of positional offset for the nozzle 191*b*. The manufacturer inputs each amount of positional offset in S21 and S22 manually as numerical values.

In S23 the CPU 2 calculates a positional offset calibration value in a method described later based on the amount of positional offset inputted in S22. In S24 the CPU 2 stores the calculated positional offset calibration value in the positional offset calibration value memory area 5*c*.

In S25 the CPU 2 calculates a tilt adjustment value indicating the relative tilt offset based on the amounts of positional offset inputted in S21 and S22 in a manner described later. In S26 the CPU 2 calculates a tilt calibration value based on the tilt adjustment value calculated in S25. The method for calculating the tilt calibration value will be described below. In S27 the CPU 2 stores this tilt calibration value in the tilt calibration value memory area 5*a* and subsequently ends the tilt calibration value acquisition process.

Next, a description will be given of the printing results obtained in the tilt adjustment pattern printing process of FIG. 5(*a*) and methods of calculating the positional offset calibration value, the tilt adjustment value, and the tilt calibration value based on these printing results, while referring to FIG. 6.

To facilitate understanding of the drawings in FIG. 6, variables n and dotted lines corresponding to the variables n are depicted. The variables n is depicted to specify the printing positions of the adjustment patterns RPas and RPbs on the recording paper by reverse prints. In the embodiment, the value of the variable n that specifies the printing position of the adjustment pattern (RPa, RPb) by the reverse print is in agreement with the value of the variable k that is used to print this adjustment pattern in the tilt adjustment pattern printing process shown in FIG. 5(*a*). For example, the printing position of the adjustment pattern RPb1 is specified by the value −2 of the variable n, and this adjustment pattern RPb1 is printed when the value of the variable k is −2. Further, in order to help visually distinguish the adjustment patterns RPas and RPbs printed in a reverse print and the adjustment patterns FPa and FPb printed in a forward print, the former is depicted by a solid line and the latter by rectangles with hatching that resemble a solid line.

In the adjustment pattern printing process described above, a pair of the adjustment pattern RPa (one of adjustment patterns RPa1-RPa5) and the adjustment pattern RPb (one of adjustment patterns RPb1-RPb5) is printed one at a time in a reverse print each time the variable k is changed sequentially from −2 to +2, i.e., each time the recording paper is conveyed one unit (1/2400 inches in this embodiment) in the paper-conveying direction B. In other words, the adjustment patterns RPa are sequentially formed beginning from the adjustment pattern RPa1 to the adjustment pattern RPa5 at each printing position corresponding to values of the variable n from −2 to +2, as shown in FIG. 6. Similarly, the adjustment patterns RPb are sequentially formed beginning from the adjustment pattern RPb1 to the adjustment pattern RPb5 at each printing position corresponding to values of the variable n from −2 to +2. A pair of the adjustment patterns FPa and FPb is printed in a forward print when the variable k is 0.

Hence, in an ideal case in which there is no relative tilt offset, the adjustment patterns FPa and FPb printed in the forward print are respectively aligned with the adjustment patterns RPa3 and RPb3 (n=0) printed in the reverse print when the variable k is 0. Hence, the adjustment pattern FPa shown in the bottom portion of FIG. 6 is the ideal case.

When there is no relative tilt offset, the distance between the adjustment patterns FPa and FPb printed in a forward print is equivalent to the distance between corresponding adjustment patterns RPa and RPb printed in reverse prints.

On the other hand, the relative tilt offset produces a difference in the length of the printing region along the paper-conveying direction B, as described above.

Since the distance between the adjustment pattern FPa and the adjustment pattern FPb printed in a forward print is different from the distance between the corresponding adjustment patterns RPa and RPb printed in reverse prints in the example shown in FIG. 6, the value of the variable n at which the printing position of the adjustment pattern FPa matches the printing position of an adjustment pattern RPa differs from the value of the variable n at which the printing position of the adjustment pattern FPb matches the printing position of an adjustment pattern RPb.

In the example shown in FIG. 6, the printing position of the adjustment pattern FPa formed by the nozzle 191*a* in a forward print is aligned with the printing position at the variable n=0 where one of the adjustment patterns RPa1-RPa5 is printed in a reverse print using the same nozzle 191*a*. However, the printing position of the adjustment pattern FPb formed by the nozzle 191*b* in a forward print is aligned with the printing position at the variable n=−2 where one of the adjustment patterns RPb1-RPb5 is printed in a reverse print using the nozzle 191*b*.

Accordingly, the distance between the adjustment patterns formed by the nozzles 191*a* and 191*b* is shorter in the reverse direction R than in the forward direction F, indicating that the head tilt during a reverse print is greater than the head tilt during a forward print.

The amount of positional offset for each of the nozzles 191*a* and 191*b* can be expressed by the value of the variable n at which the printing position in the forward print matches the printing position in a reverse print for the respective nozzles 191*a* or 191*b* in the paper-conveying direction B.

In the example shown in FIG. 6, the amount of positional offset is 0 for the nozzle 191*a* (illustrated in the bottom portion of FIG. 6). Therefore, the manufacturer inputs a "0" in S21 of the tilt calibration value acquisition process described above with reference to FIG. 5(*b*). However, the amount of positional offset is found to be −2 for the nozzle 191*b* (illustrated in the top portion of FIG. 6). Accordingly, the manufacturer inputs a "−2" in S22 of the same process.

Here, the adjustment pattern (FPa or FPb) by a forward print is printed when k=0, and this adjustment pattern (FPa or FPb) is compared with the adjustment pattern (RPa or RPb) by the reverse print. The amount of positional offset for a certain nozzle 191 is a negative value when the printing position of the nozzle 191 during a reverse print is upstream of the printing position of the nozzle 191 during a forward print relative to the paper-conveying direction B. Conversely, the amount of positional offset is a positive value when the printing position of the nozzle 191 during a reverse print is downstream of the printing position during a forward print relative to the paper-conveying direction B.

Further, the positional offset calibration value is found by multiplying {(variable n corresponding to the adjustment pattern RPb printed at the same position as the adjustment pattern FPb in the paper-conveying direction B)−(variable k that is used when the adjustment pattern FPb is printed)} by the paper-conveying distance for increasing the variable n by 1 (1/2400 inches in the embodiment). Here, the "variable n corresponding to the adjustment pattern RPb printed at the same position as the adjustment pattern FPb in the paper-conveying direction B" is equivalent to the amount of positional offset for the nozzle 191*b* (−2 in the example shown in FIG. 6). The "variable k that is used when the adjustment pattern FPb is printed" is 0 in the embodiment.

In the example shown in FIG. 6, the positional offset calibration value is $\{(-2)-0\}\times(1/2400)=-1/1200$. Hence, in S24 of the tilt calibration value acquisition process described above in FIG. 5(*b*), the value −1/1200 is stored in the positional offset calibration value memory area 5*c*.

The tilt adjustment value is found by subtracting the amount of positional offset for the nozzle 191*b* from the amount of positional offset for the nozzle 191*a*. In the example shown in FIG. 6, the tilt adjustment value is found to be −2 from the calculation (−2)−0.

That is, the tilt adjustment value indicates a difference between two values. Here, one value is determined by a length in the paper-conveying direction between the printing position of the image formed by the nozzle 191*a* during the forward print and the printing position of the image formed by the nozzle 191*a* during the reverse print, and another value is determined by a length in the paper-conveying direction between the printing position of the image formed by the nozzle 191*b* during the forward print and the printing position of the image formed by the nozzle 191*b* during the reverse print. Alternatively, one value is determined by a length in the paper-conveying direction between the printing position of the image formed by the nozzle 191*a* during the forward print and the printing position of the image formed by the nozzle 191*b* during the forward print, and another value is determined by a length in the paper-conveying direction between the printing position of the image formed by the nozzle 191*a* during the reverse print and the printing position of the adjustment pattern formed by the nozzle 191*b* during the reverse print.

The tilt calibration value is found by multiplying the paper-conveying distance for increasing the variable n by 1 (1/2400 inches in the embodiment) by the tilt adjustment value. In the example shown in FIG. 6, the tilt calibration value found in S26 is (1/2400 inches)×(−2)=−1/1200 inches. This value of −1/1200 is stored in the tilt calibration value memory area 5*a* in S27.

In the embodiment, the manufacturer visually confirms the printing results from the tilt adjustment pattern printing process of FIG. 5(*a*) to determine the position at which the adjustment pattern FPa matches an adjustment pattern RPa (one of the adjustment patterns RPa1-RPa5) in the paper-conveying direction B and the position at which the adjustment pattern FPb matches an adjustment pattern RPb (one of the adjustment patterns RPb1-RPb5) in the paper-conveying direction B. The manufacturer acquires the amount of positional offset for each of the nozzles 191*a* and 191*b* based on the positions.

Alternatively, the printing results of the adjustment patterns may be read as image data with an image-reading device such as a scanner or a CCD camera, and an image sensor may be used to determine the position at which the adjustment pattern FPa is aligned with an adjustment pattern RPa and the position at which the adjustment pattern FPb is aligned with an adjustment pattern RPb and to output offset amounts obtained based on these alignment positions. In this case, the offset amounts may be outputted to a monitor or to the printer 1 via a cable. In the latter case, the printer 1 may be configured to execute the tilt calibration value acquisition process of FIG. 5(*b*) upon receiving the inputted offset amounts. The device acquiring the offsets for the nozzles 191*a* and 191*b* in the paper-conveying direction B based on the adjustment patterns FPa, FPb, RPa, and RPb may be an external device or a device built into the printer 1.

Next, a method for finding a conveying distance calibration value will be described with reference to FIGS. 7(*a*) and 7(*b*). This conveying distance calibration value is used to calibrate offset between a predicted conveying distance and an actual conveying distance (hereinafter referred to as "conveyance offset").

Figure 7B:
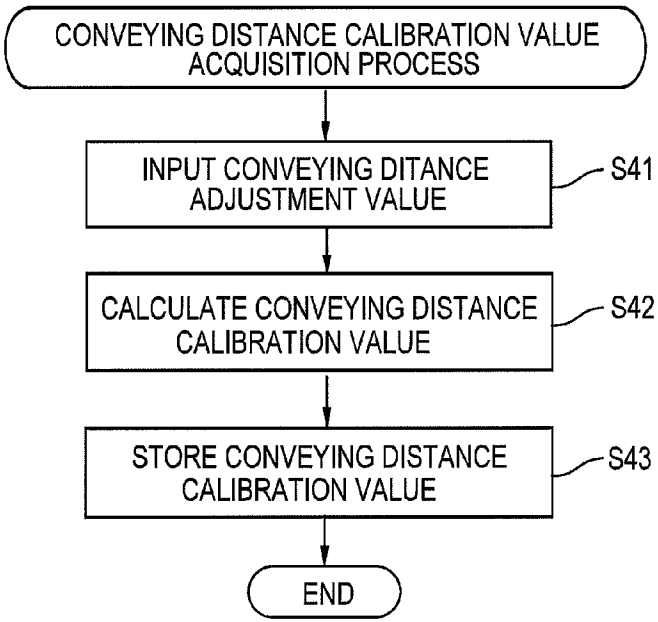
FIG. 7(*a*) is a flowchart illustrating steps in a conveying distance adjustment pattern printing process executed by the printer.
Figure 7A:
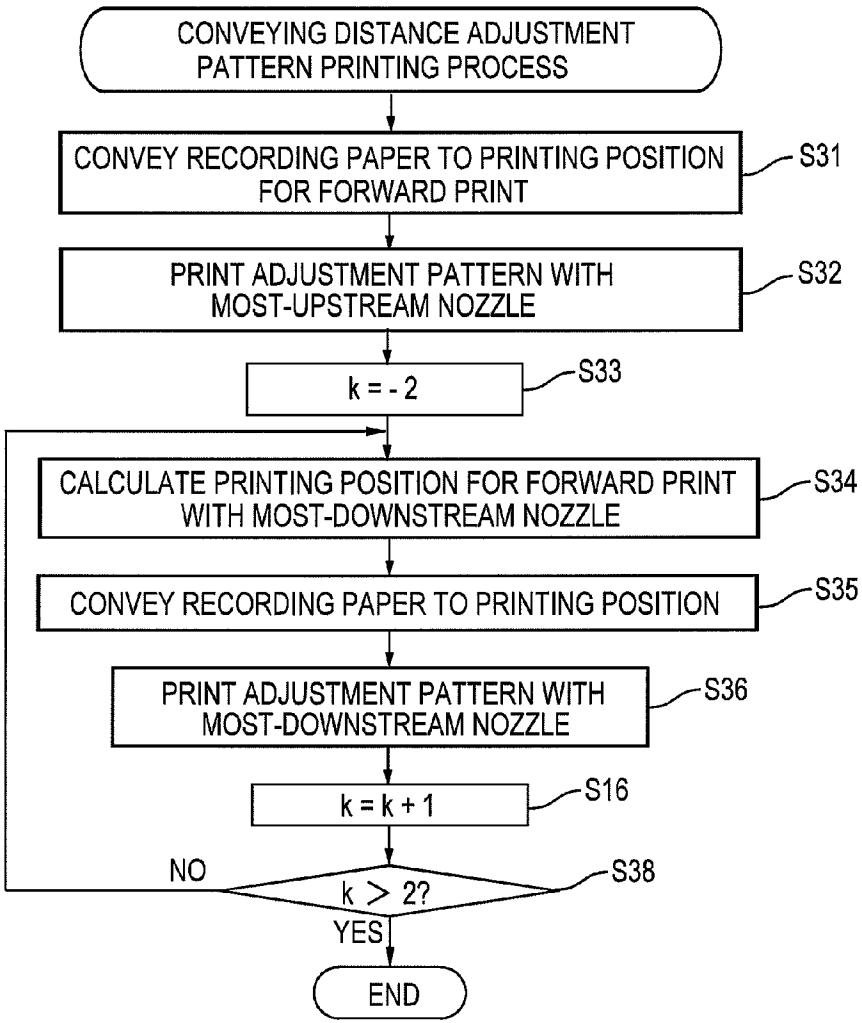

FIG. 7(*a*) is a flowchart illustrating steps in the conveying distance adjustment pattern printing process executed by the CPU 2 of the printer 1. FIG. 7(*b*) is a flowchart illustrating steps in the conveying distance calibration value acquisition process executed by the CPU 2 of the printer 1.

The manufacturer initiates the conveying distance adjustment pattern printing process shown in FIG. 7(*a*) in the factory prior to shipping the product by performing a prescribed operation. This process may be performed together with the tilt adjustment pattern printing process of FIG. 5(*a*) described above. The conveying distance adjustment pattern printing process is executed based on the conveying distance adjustment pattern printing program 3*d*. Based on the printed results, the manufacturer can acquire a conveying distance adjustment value in a manner described later, and a conveying distance calibration value can be obtained in a conveying distance calibration value acquisition process described in FIG. 7(*b*).

In S31 at the beginning of the conveying distance adjustment pattern printing process, the CPU 2 controls to convey a sheet of recording paper to a printing position for the nozzle 191*a*. In S32 the CPU 2 controls the nozzle 191*a* to print an adjustment pattern FPc (see FIG. 8) in a forward print on the recording paper at the printing position.

In S33 the CPU 2 initializes the variable k to −2. The variable k indicates the printing position of the recording paper. When the variable k is 0, the nozzle 191*b* targets on the position with respect to the paper-conveying direction B where the adjustment pattern FPc is printed by the nozzle 191*a* in S32. That is, if there is no conveyance offset between the predicted conveying distance and the actual conveying distance, the adjustment pattern (FPd3) printed by the nozzle 191*b* when k=0 is printed at the position of the adjustment pattern FPc in the paper-conveying direction B.

In S34 the CPU 2 calculates a printing position of the recording paper for the nozzle 191*b* according to this value of the variable k. In S35 the CPU 2 conveys the recording paper to the calculated printing position. In the embodiment, the recording paper is conveyed one unit (1/2400 inches) in the paper-conveying direction B each time the variable k increments by one. In S36 the CPU 2 controls the nozzle 191*b* to print an adjustment pattern FPd (see FIG. 8) in a forward print at the current printing position. That is, through the process in S36, the CPU 2 prints an adjustment pattern FPd (one of the adjustment patterns FPd1-FPd5) at a position according to the value of the variable k.

In S37 the CPU 2 increments the variable k by 1 and in S38 determines whether the variable k is greater than 2. If the variable k is not greater than 2 (S38: NO), the CPU 2 returns to S34 and repeats the processes in S34-S38.

Figure 8:
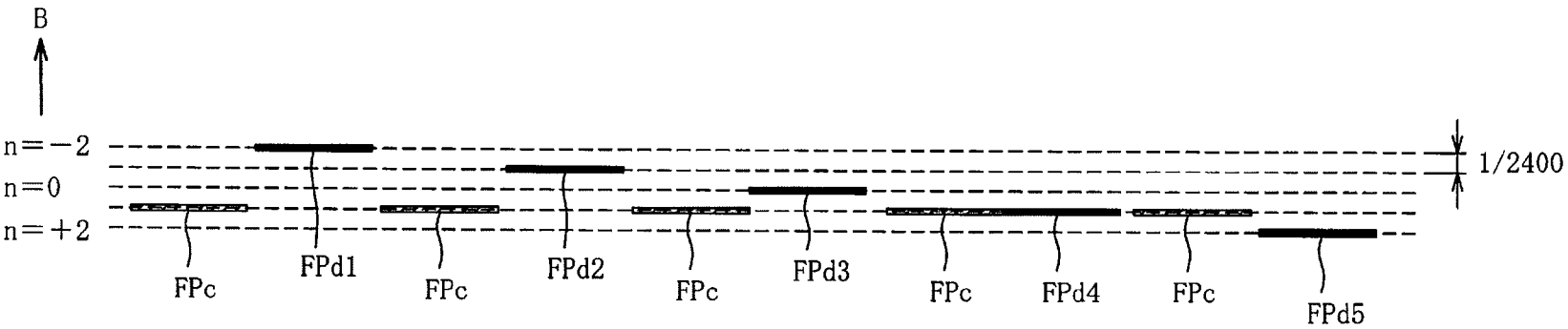
FIG. 8 is a view conceptually illustrating printing results obtained by the conveying distance adjustment pattern printing process.

On the other hand, if the CPU 2 determines that the value of the variable k is greater than 2 (S38: YES), then the conveying distance adjustment pattern printing process ends. The printing result as shown in FIG. 8 is obtained after performing the conveying distance adjustment pattern printing process. A conveying distance adjustment value that is an amount of conveyance offset is obtained based on the printing result in a manner described later.

The manufacturer initiates the conveying distance calibration value acquisition process shown in FIG. 7(*b*) in the factory prior to shipping the product by performing a prescribed operation and after performing the above described conveying distance adjustment pattern printing process. The conveying distance calibration value acquisition process is performed based on the conveying distance calibration value acquisition program 3*e*. When the conveying distance calibration value acquisition process is executed, first, in S41 the manufacturer manually inputs the conveying distance adjustment value obtained in a method to be described below.

Subsequent to S41, in S42 the CPU 2 calculates a conveying distance calibration value based on the conveying distance adjustment value inputted in S41, in a method to be described below. In S43 the CPU 2 stores the conveying distance calibration value calculated in S42 into the reference conveying distance calibration value memory area 5*b* and ends the conveying distance calibration value acquisition process.

Here, the printing results obtained from the conveying distance adjustment pattern printing process described in FIG. 7(*a*) will be described with reference to FIG. 8, as well as a method of obtaining an amount of conveyance offset (conveying distance adjustment value) based on the printing results.

FIG. 8 conceptually illustrates an example of printing results obtained in the process of FIG. 7(*a*). To facilitate understanding of the drawings in FIG. 8, variables n and dotted lines corresponding to the variables n are depicted. The variables n is depicted to specify the printing positions of the adjustment patterns FPd on the recording paper by the print nozzle 191*b*. Specifically, the value of the variable n that specifies the position of the adjustment pattern by the print nozzle 191*b* is in agreement with the value of the variable k that is used to print this adjustment pattern. For example, the position of the adjustment pattern FPd1 is specified by the value −2 of the variable n, and this adjustment pattern FPd1 is printed when the value of the variable k is −2. Further, in order to help visually distinguish the adjustment patterns FPcs and FPds, the former is depicted by a solid line and the latter by rectangles with hatching that resemble a solid line.

In the conveying distance adjustment pattern printing process of FIG. 7(*a*) described above, the nozzle 191*b* prints the adjustment pattern FPd once each time the variable k is incremented by 1 from its initial value of −2 to the value +2, i.e., each time the recording paper is conveyed one unit (1/2400 inches in the embodiment) in the paper-conveying direction B. Hence, adjustment patterns FPd are sequentially formed beginning from the adjustment pattern FPd1 to the adjustment pattern FPd5 at each printing position corresponding to values of the variable k from −2 to +2, as shown in FIG. 8.

In the conveying distance adjustment pattern printing process of FIG. 7(*a*), the adjustment pattern FPc is printed at what is estimated to be the same printing position as the adjustment pattern FPd3, which is printed when k=0. In an ideal case in which the predicted conveying distance matches the actual conveying distance, the adjustment pattern FPc is printed at the same position as the adjustment pattern FPd3 with respect to the paper-conveying direction B.

However, as shown in the example of FIG. 8, when there is conveyance offset, i.e., a difference (offset) between the predicted conveying distance and the actual conveying distance, the adjustment pattern FPc and the adjustment pattern FPd3 are printed at different positions.

FIG. 8 shows a case in which the adjustment pattern FPc is printed at the same position as the adjustment pattern FPd4 corresponding to n=+1 (k=+1). The conveying distance adjustment value is found by subtracting the value of the variable k associated with the adjustment pattern FPc (k=0 in the embodiment) from the value of the variable n corresponding to the adjustment pattern FPd printed at the same position as the adjustment pattern FPc in the paper-conveying direction B.

Hence, the conveying distance adjustment value is found from the equation [(conveying distance adjustment value)=(value of variable n corresponding to the adjustment pattern FPd printed at same position as the adjustment pattern FPc)−(value of variable k associated with the printing position of the adjustment pattern FPc)]. In the example of FIG. 8, the conveying distance adjustment value is found to be +1 from the calculation (+1)−0.

Since the value of the variable k associated with the printing position of the adjustment pattern FPc is 0 in the embodiment, the conveying distance adjustment value is a negative value when the actual conveying distance is longer than the predicted conveying distance and a positive value when the actual conveying distance is shorter than the predicted conveying distance.

The conveying distance calibration value is found by multiplying the paper-conveying distance when incrementing the variable n by 1 (1/2400 inches in the embodiment) by the conveying distance adjustment value. Using the example shown in FIG. 8, the conveying distance calibration value found in S42 of the process described in FIG. 7(*b*) is (1/2400 inches)×(+1)=+1/2400 inches. This value of +1/2400 is stored in the reference conveying distance calibration value memory area 5*b*.

In the embodiment, the manufacturer visually determines the position at which the adjustment pattern FPc matches an adjustment pattern FPd (one of the adjustment patterns FPd1-FPd5) in the paper-conveying direction B based on the printed results obtained in the conveying distance adjustment pattern printing process of FIG. 7(*a*) and sets the conveying distance adjustment value based on this position.

Alternatively, the printing results of the adjustment patterns may be read as image data with an image-reading device such as a scanner or a CCD camera, and an image sensor may be used to determine the position at which the adjustment pattern FPc is aligned with an adjustment pattern RPd and to output offset amounts obtained based on these alignment positions. In this case, the offset amounts may be outputted to a monitor or to the printer 1 via a cable. In the latter case, the printer 1 may be configured to execute the conveying distance calibration value acquisition process of FIG. 7(*b*) upon receiving the inputted conveying distance adjustment value. The device acquiring the conveying distance adjustment value based on the adjustment patterns FPc and FPd may be an external device or a device built into the printer 1.

Figure 9:
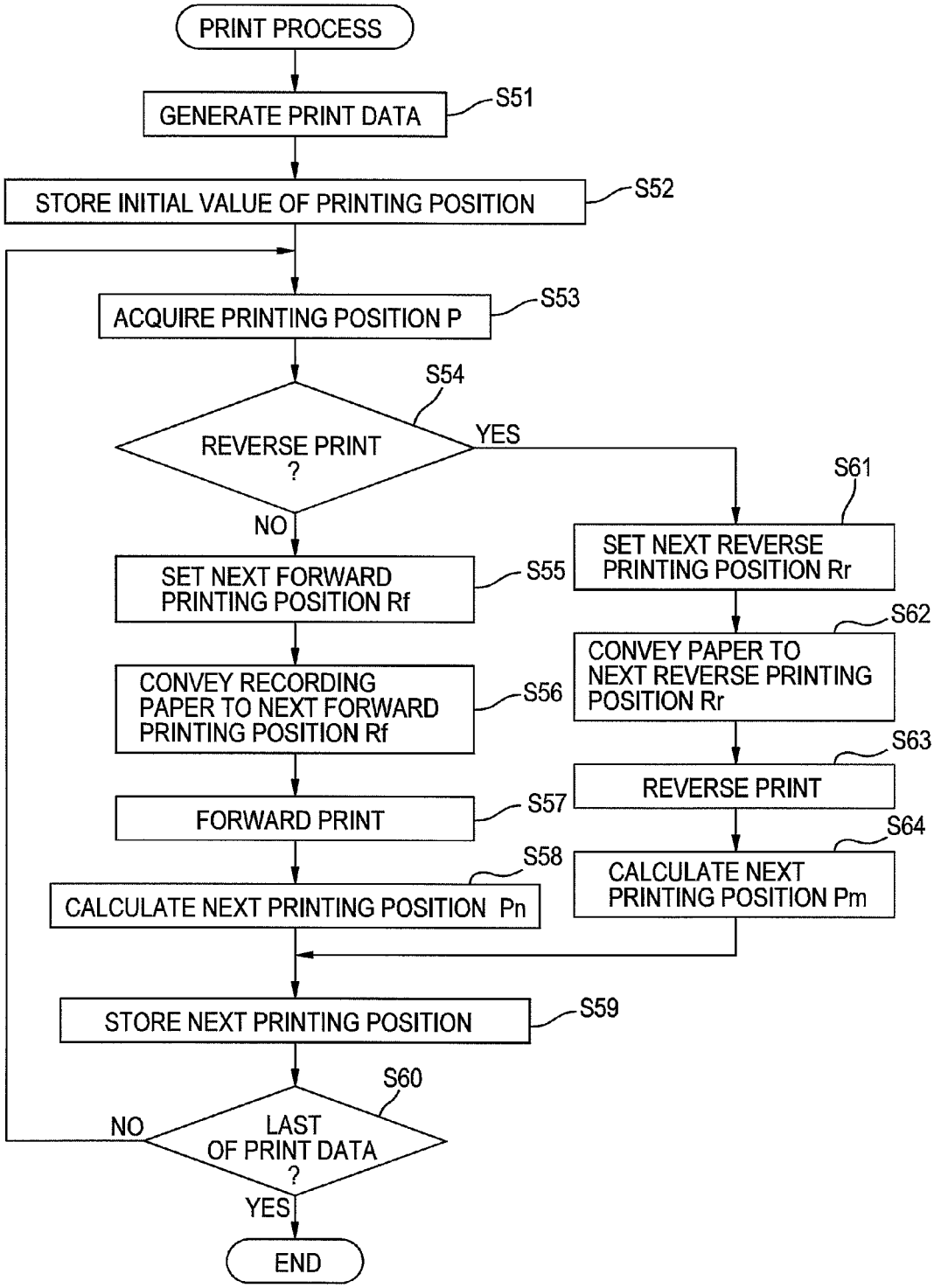
FIG. 9 is a flowchart illustrating steps in a normal printing process executed by the printer.

Next, a printing process executed by the printer 1 of the embodiment will be described with reference to FIG. 9. FIG. 9 is a flowchart illustrating steps in the printing process executed by the CPU 2 of the printer 1 based on the normal print control program 3*a* stored in the ROM 3. For simplification, the following description will assume that the predicted conveying distance is the same as the actual conveying distance (i.e., the conveying distance calibration value stored in the conveying distance calibration value memory area 5*b* is 0).

The printing process shown in FIG. 9 is executed when the user issues a print command while normal bi-directional printing (printing at different positions in forward prints and reverse prints) is selected. In S51 of the printing process, the CPU 2 generates print data from the image data to be printed (image data inputted from a PC, for example). In S52 the CPU 2 stores an initial value of the printing position (the initial position of the recording paper fed into the printer 1) as a printing position P in the printing position memory area 4*a*.

In S53 the CPU 2 acquires the printing position P from the printing position memory area 4*a*, and in S54 determines whether the next print is a reverse print. If the next print is a forward print (S54: NO), in S55 the CPU 2 sets a next forward printing position Rf to the printing position P acquired in S53. In S56 the CPU 2 conveys the sheet of recording paper to the next forward printing position Rf and in S57 performs a forward print at this position.

In the process of S56, the CPU 2 sets a paper-conveying distance (target rotational amount of the conveying roller 20*a*) to the difference between the current printing position and the next forward printing position Rf, and conveys the recording paper to the next forward printing position Rf by rotating the conveying roller 20*a* the target rotational amount while detecting the rotational amount of the conveying roller 20*a* with the LF encoder 18.

In S58 the CPU 2 calculates a next printing position Pn and sets the printing position P as the current printing position, and in S59 stores the calculated next printing position Pn in the printing position memory area 4*a* as the printing position P.

The next printing position Pn is calculated in S58 according to the equation (printing position P stored in the printing position memory area 4*a*)+(conveying distance M per pass regulated by the printing mode). When printing at a resolution equivalent to a nozzle resolution (the inverse of the nozzle pitch R formed in the print head 190 along the sub-scanning direction) in one pass of either a forward print or a reverse print, the (conveying distance M per pass regulated by the printing mode) is equivalent to (number of nozzles N aligned in the sub-scanning direction)×(nozzle pitch R).

On the other hand, if the next print is a reverse print (S54: YES), in S61 a next reverse printing position Rr is set to a value obtained by calibrating the printing position P acquired in S53 with the positional offset calibration value δ stored in the positional offset calibration value memory area 5*c*, i.e., a value equivalent to (printing position P)+(positional offset calibration value δ stored in the positional offset calibration value memory area 5*c*).

In S62 the CPU 2 conveys the recording paper to the next reverse printing position Rr acquired in S61 and in S63 performs a reverse print at this position. In the process of S62, the CPU 2 sets a paper-conveying distance (target rotational amount of the conveying roller 20*a*) to the distance between the current printing position and the next reverse printing position Rr, and conveys the recording paper to the next reverse printing position Rr by rotating the conveying roller 20*a* the target rotational amount while detecting the rotational amount of the conveying roller 20*a* with the LF encoder 18.

In S64 the CPU 2 calculates a next printing position Pm and sets the printing position as the current printing position, and subsequently advances to S59 to store the next printing position Pm calculated in S64 in the printing position memory area 4*a* as the printing position P.

The next printing position Pm is calculated in S64 according to the equation (printing position P stored in the printing position memory area 4*a*)+(conveying distance M per pass regulated by the printing mode)+(tilt calibration value γ stored in the tilt calibration value memory area 5*a*)−(positional offset calibration value δ stored in the positional offset calibration value memory area 5*c*).

In S60 the CPU 2 determines whether the print data just printed is the last of the print data. If there still remains data to be printed (S60: NO), the CPU 2 returns to S53 and executes another print based on print data that has not yet been printed. However, if the last of the print data has been printed (S60: YES), the CPU 2 ends the current printing process.

Figure 10A:
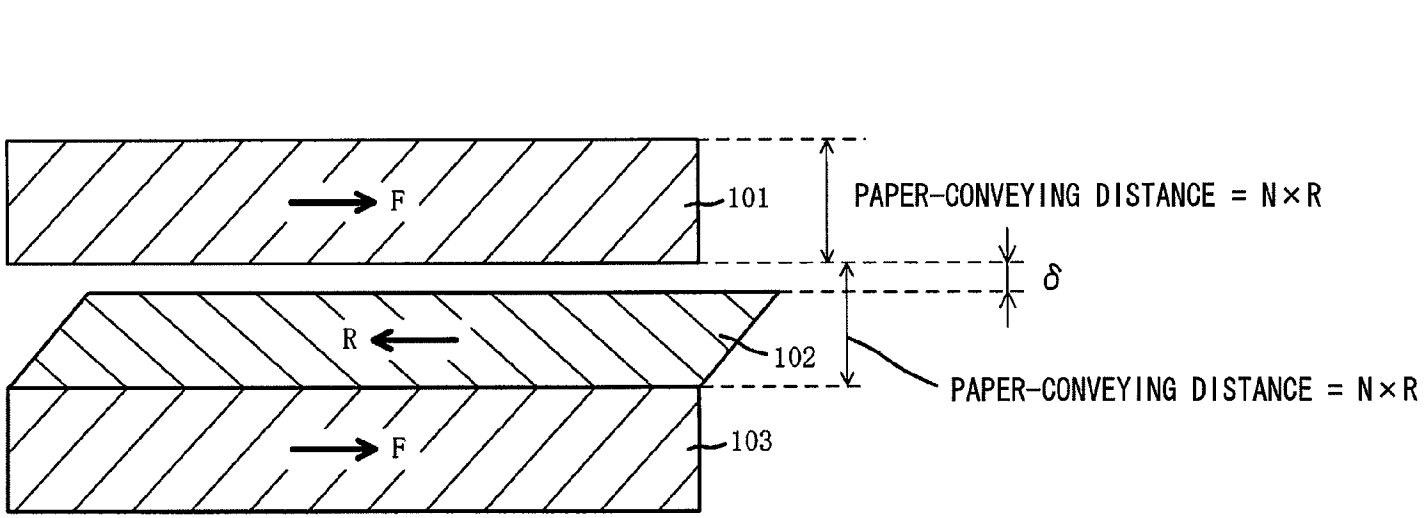
FIG. 10(*a*) is a view conceptually illustrating printing results when there is offset between tilt in the print head relative to the paper-conveying direction when performing a forward print and tilt in the print head relative to the paper-conveying direction when performing a reverse print.
Figure 10B:
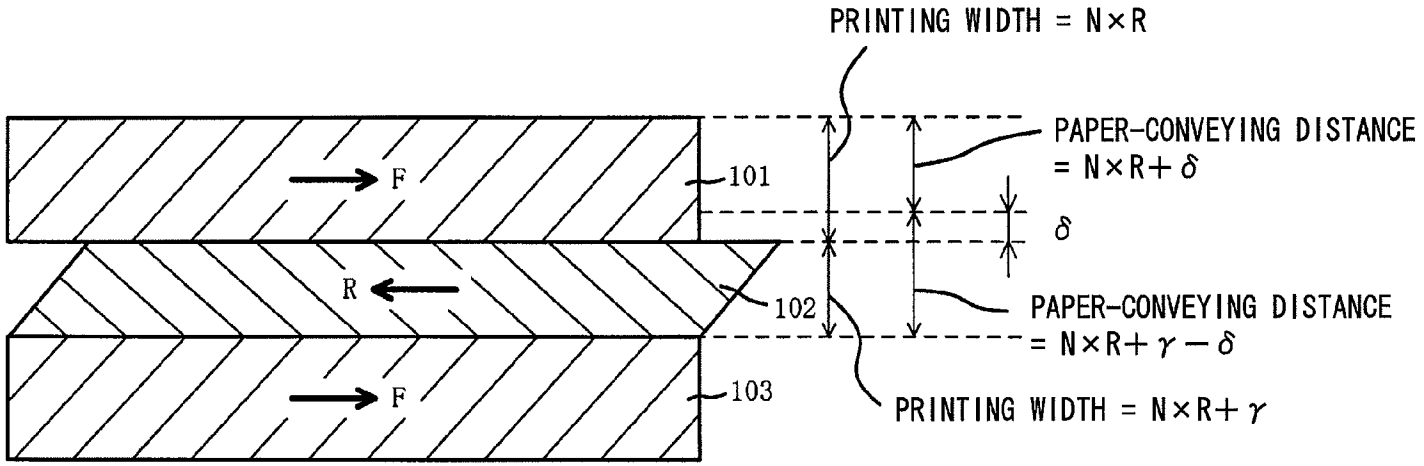

Next, the effects obtained by executing the printing process in FIG. 9 will be described with reference to FIGS. 10(*a*), 10(*b*). FIG. 10(*a*) conceptually illustrates printing results obtained when there is a relative tilt offset, but a paper conveying distance is not calibrated using the tilt calibration value γ nor the positional offset calibration value δ. FIG. 10(*b*) conceptually illustrates printing results obtained when executing the printing process in FIG. 9 described above.

As shown in FIG. 10(*a*), when there is a relative tilt offset, a gap having a width corresponding to the positional offset calibration value δ stored in the positional offset calibration value memory area 5*a* is produced between a printing region 101 printed in a $P^{th}$ pass of a forward print and a printing region 102 printed in a $(P+1)^{th}$ pass of a reverse print.

As described above, in the printing process of FIG. 9 executed by the printer 1 of the embodiment, the conveying distance used after performing a forward print, which is the reference conveying direction, is calculated according to the equation (number of nozzles N aligned in the sub-scanning direction)×(nozzle pitch R)+(positional offset calibration value δ stored in the positional offset calibration value memory area 5*c*), as shown in FIG. 10(*b*).

On the other hand, the paper-conveying distance used to convey the recording paper following a reverse print is set to a value obtained by calibrating the paper-conveying distance with the tilt calibration value γ stored in the tilt calibration value memory area 5*a* and the positional offset calibration value δ in the positional offset calibration value memory area 5*c*, i.e., N×R+γ−δ, as shown in FIG. 10(*b*).

This calibration has the effect of taking up the width equivalent to the positional offset calibration value δ to eliminate the gap between the printing regions 101 and 102, as shown in FIG. 10(*b*), thereby achieving continuous printing results in the printing regions 101, 102, and 103 with no gaps produced therebetween.

Next, an overlap printing process executed by the printer 1 of this embodiment will be described with reference to FIGS. 11 and 12. The CPU 2 of the printer 1 executes the overlap printing process based on the overlap printing control program 3*f* stored in the ROM 3 when the user issues a print command while overlap printing is selected. In the overlap printing process, after one of a forward print and a reverse print is performed, another one of the forward print and the reverse print is executed over the printed results of the one of the forward print and the reverse print.

Figure 11:
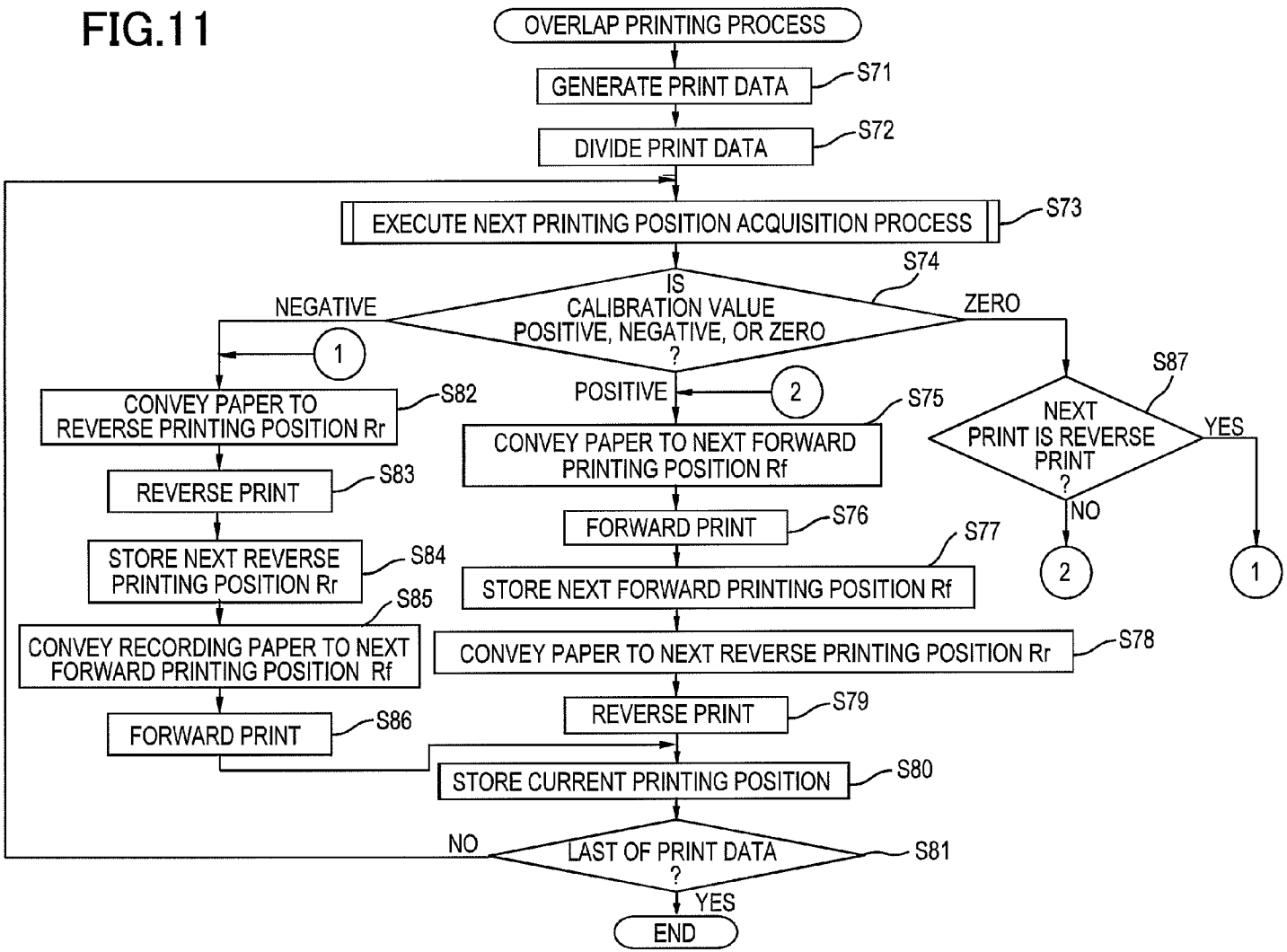
FIG. 11 is a flowchart illustrating an overlap printing process executed by the printer.

FIG. 11 is a flowchart illustrating the overlap printing process executed by the CPU 2. FIG. 12 is a flowchart illustrating a next printing position acquisition process that is executed in the overlap printing process shown in FIG. 11.

In S71 of the overlap printing process shown in FIG. 11, the CPU 2 generates print data from image data to be printed (image data inputted from a PC, for example). In S72, the CPU 2 divides the print data into segments for performing overlap printing.

In S73 the CPU 2 executes the next printing position acquisition process for acquiring the printing position for the next print. The next printing position acquisition process of S73 will be described with reference to FIG. 12. In S91 of the process in FIG. 12, the CPU 2 first determines whether the next print is the initial print. If the next print is the initial print (S91: YES), in S92 the CPU 2 stores an initial value for the printing position (initial position when the recording paper is fed into the printer 1) into the printing position memory area 4*a* as a printing position P, sets the initial value for the printing position as the previous forward printing position PRf, and subsequently advances to S93. The previous forward printing position PRf indicates a position for a previous forward print. On the other hand, if the next print is not the initial print (S91: NO), the CPU 2 skips S92 and advances directly to S93.

In S93 the CPU 2 acquires the previous forward printing position PRf from the printing position memory area 4*a*. In S94 the CPU 2 calculates a next printing position PN by adding (a conveying distance applied for forward prints) to (the previous forward printing position PRf). The conveying distance applied to forward prints is calculated according to the equation (number of nozzles N aligned in the sub-scanning direction)×(nozzle pitch R)+conveying distance calibration value β.

In S95 the CPU 2 sets the next forward printing position Rf to the next printing position PN. In S96 the CPU 2 calibrates the next printing position PN using the positional offset calibration value δ stored in the positional offset calibration value memory area 5*c* and sets a next reverse printing position Rr to the calibrated value. Subsequently, the CPU 2 ends the next printing position acquisition process of S73 and returns to the printing process of FIG. 11.

Returning to FIG. 11, in S74 the CPU 2 references the positional offset calibration value δ that has been stored in the positional offset calibration value memory area 5*c* and determines whether the positional offset calibration value δ is a positive value, a negative value, or zero. In the case of a positive value, i.e., when the printing position for a forward print using the nozzle 191*b* is positioned upstream of the printing position for a reverse print in the paper-conveying direction B (S74: positive), in S75 the CPU 2 conveys a sheet of recording paper to the next forward printing position Rf acquired in S95 of FIG. 12 and in S76 performs the forward print at this position. In S77 the CPU 2 stores the next forward printing position Rf into the printing position memory area 4*a* as a printing position P.

In the process of S75, the CPU 2 sets a paper-conveying distance (target rotational amount of the conveying roller 20*a*) to the distance from the current printing position (printing position P stored in the printing position memory area 4*a*) to the next forward printing position Rf, and conveys the recording paper to the next forward printing position Rf by rotating the conveying roller 20*a* the target rotational amount while detecting the rotational amount of the conveying roller 20*a* with the LF encoder 18.

After completing the process of S77, in S78 the CPU 2 conveys the recording paper to the next reverse printing position Rr acquired in S96 of FIG. 12, in S79 performs a reverse print at this position, and subsequently advances to S80. In the process of S78, the CPU 2 sets the paper-conveying distance (target rotational amount of the conveying roller 20*a*) to the distance from the current printing position (the printing position P stored in the printing position memory area 4*a*) to the next reverse printing position Rr, and conveys the recording paper to the next reverse printing position Rr by rotating the conveying roller 20*a* the target rotational amount while detecting the rotational amount of the conveying roller 20*a* with the LF encoder 18.

Figure 12:
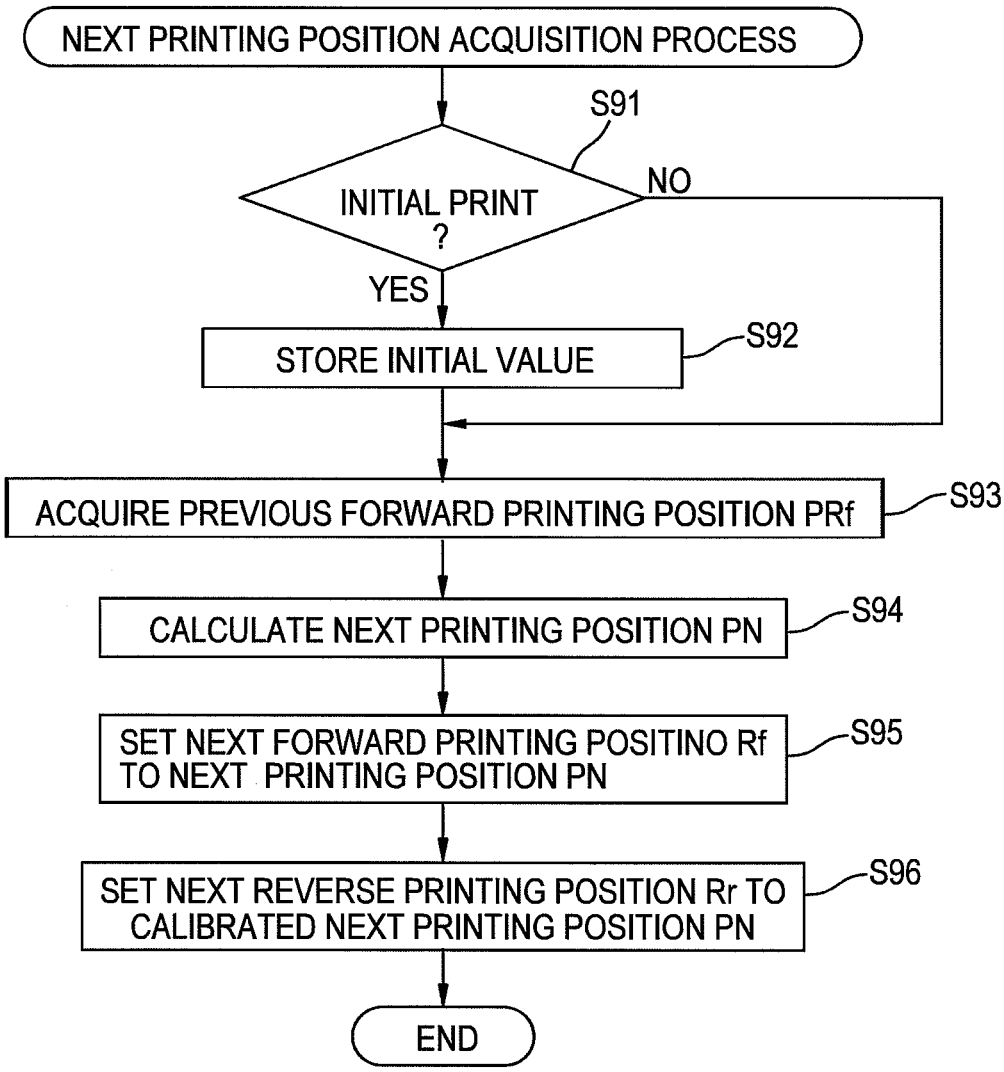
FIG. 12 is a flowchart illustrating a next printing position acquisition process that is executed in the overlap printing process shown in FIG. 11.

However, if the CPU 2 determines that the positional offset calibration value δ stored in the positional offset calibration value memory area 5*c* is a negative value, i.e., when the printing position for a reverse print with the nozzle 191*b* is positioned upstream of the printing position for a forward print in the paper-conveying direction B (S74: negative), in S82 the CPU 2 conveys the recording paper to the next reverse printing position Rr acquired in S96 of FIG. 12 and in S83 performs the reverse print at this position. In S84 the CPU 2 stores the next reverse printing position Rr into the printing position memory area 4*a* as a printing position P.

In the process of S82, the CPU 2 sets the paper-conveying distance (target rotational amount of the conveying roller 20*a*) to the distance from the current printing position (the printing position P stored in the printing position memory area 4*a*) to the next reverse printing position Rr, and conveys the recording paper to the next reverse printing position Rr by rotating the conveying roller 20*a* the target rotational amount while detecting the rotational amount of the conveying roller 20*a* with the LF encoder 18.

After completing the process of S84, in S85 the CPU 2 conveys the recording paper to the next forward printing position Rf acquired in S95 of FIG. 12, in S86 performs a forward print at this position, and subsequently advances to S80. In the process of S85, the CPU 2 sets the paper-conveying distance (target rotational amount of the conveying roller 20*a*) to the distance from the current printing position (the printing position P stored in the printing position memory area 4*a*) to the next forward printing position Rf, and conveys the recording paper to the next forward printing position Rf by rotating the conveying roller 20*a* the target rotational amount while detecting the rotational amount of the conveying roller 20*a* with the LF encoder 18.

In S80 the CPU 2 stores, as a printing position P, the printing position used in the printing operation S79 (the reverse printing position Rr) or S86 (the forward printing position Rf) into the printing position memory area 4*a* and sets the forward printing position Rf as a previous forward printing position PRf. In S81 the CPU 2 determines whether the print data just printed is the last of the print data. If there still remains data to be printed (S81: NO), the CPU 2 returns to S73 and executes a printing operation based on print data that has not yet been printed. However, if the last of the print data has been printed (S81: YES), the CPU 2 ends the current printing process.

If the CPU 2 determines that the positional offset calibration value stored in the positional offset calibration value memory area 5*c* is zero (S74: zero), then, in S87, the CPU 2 determines whether the next print is a reverse print. If not (S87:NO), then the CPU 2 advances to S75. On the other hand, if so (S87:YES), then the CPU 2 advances to S82.

Figure 13A:
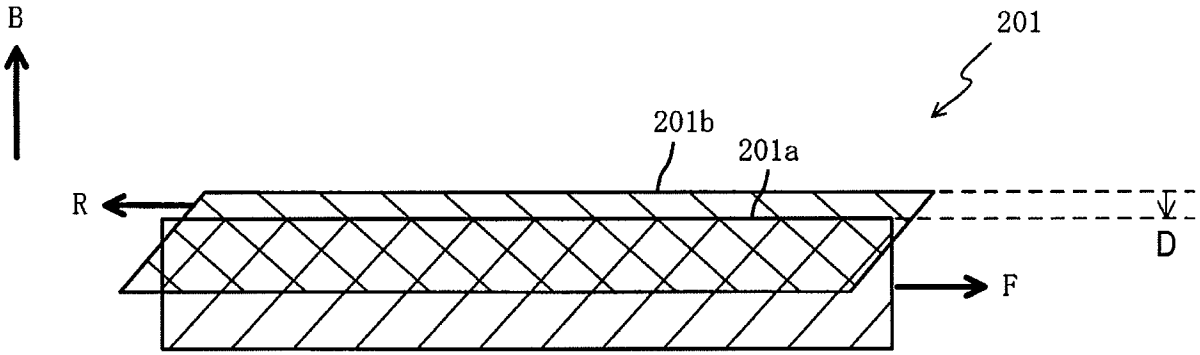
FIG. 13(*a*) is a view conceptually illustrating printing results for overlap printing obtained when a printing position for a reverse print is positioned downstream of a printing position for a forward print in the paper-conveying direction.
Figure 13B:
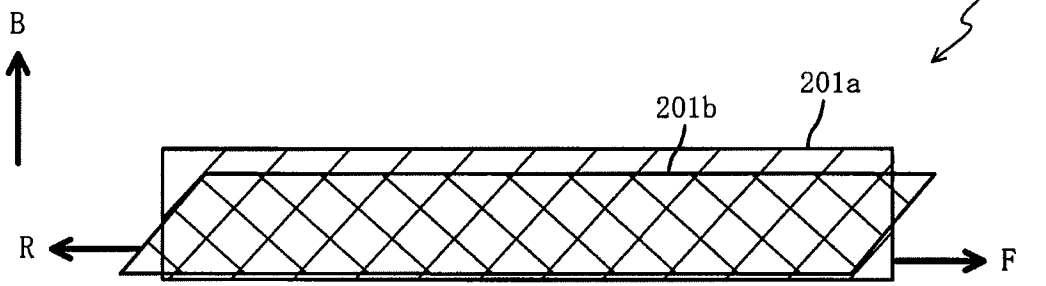

Next, the effects obtained by executing the overlap printing process in FIG. 11 will be described with reference to FIGS. 13(*a*), 13(*b*). FIG. 13(*a*) conceptually illustrates printing results for overlap printing obtained when a printing position 201*b* for a reverse print with the nozzle 191*b* is positioned downstream of a printing position 201*a* for a forward print in the paper-conveying direction B. FIG. 13(*a*) only shows a printing region 201 in which dots are formed by a single forward print or a single reverse print.

In the case illustrated in FIG. 13(*a*), the printing position 201*b* for a reverse print with the nozzle 191*b* is downstream of the printing position 201*a* for a forward print in the paper-conveying direction B. It is conceivable to perform the reverse print prior to the forward print. In this conceivable case, it is necessary to convey the recording paper in reverse (i.e., the direction opposite the paper-conveying direction B).

However, by performing the overlap printing process of FIG. 11, the printer 1 according to the embodiment can perform the forward print first at the noncalibrated current printing position and subsequently calibrate the printing position for the reverse print and perform the reverse print at the calibrated printing position when the positional offset calibration value δ stored in the positional offset calibration value memory area 5*c* is positive. In other words, the printer 1 according to the embodiment can adjust the printing position 201*b* for the reverse print in the direction upstream in the paper-conveying direction B as indicated by an arrow D when the positional offset calibration value δ stored in the positional offset calibration value memory area 5*c* is positive. Accordingly, an overlap printing process can be performed without having to convey the recording paper in reverse.

FIG. 13(*b*) conceptually illustrates printing results for overlap printing when the printing position 201*a* for a forward print with the nozzle 191*b* is downstream of the printing position 201*b* for a reverse print in the paper-conveying direction B. As with FIG. 13(*a*), FIG. 13(*b*) shows only shows single printing region 201 in which dots are formed by a single forward print or a single reverse print.

In the case illustrated in FIG. 13(*b*), the printing position 201*a* for a forward print with the nozzle 191*b* is positioned downstream of the printing position 201*b* for a reverse print. It is conceivable to perform the forward print prior to the reverse print. In this conceivable case, it is necessary to convey the recording paper in reverse (i.e., the direction opposite the paper-conveying direction B) in order to perform the reverse print.

However, by performing the overlap printing process in FIG. 11, the printer 1 according to the embodiment can adjust the printing position 201*b* for the reverse print in the direction downstream in the paper-conveying direction B when the positional offset calibration value δ stored in the positional offset calibration value memory area 5*c* is negative, and perform the reverse print at the calibrated current printing position and the forward print at the noncalibrated current printing position in this order. Accordingly, an overlap printing process can be performed without having to convey the recording paper in reverse.

When performing overlap printing, in S94 of the next printing position acquisition process (see FIG. 12), the printer 1 may find the next printing position PN according to the equation (next printing position PN)=(previous forward printing position PRf)+{(number of nozzles N aligned in the sub-scanning direction)×(nozzle pitch R)+(conveying distance calibration value β)}, and in S96 the printer may find the next reverse printing position Rr from the equation (previous forward printing position PRf)+{(number of nozzles N aligned in the sub-scanning direction)×(nozzle pitch R)+(conveying distance calibration value β)}+(positional offset calibration value δ)−(γ/2). According to these calculations, the printer 1 can align the center of the printing region for a forward print with the center of the printing region for a reverse print. Therefore, the printer 1 can suppress a decline in image quality by making the center of the printing region for the forward print match the center of the printing region for the reverse print in the paper-conveying direction B.

As described above, during the overlap printing, the printer 1 according to the embodiment regulates the printing position based on a recording condition for one printing direction (the forward direction F in the embodiment), regardless of relative tilt offset, while calibrating the printing position for the other printing direction (the reverse direction R in the embodiment) based on the relative tilt offset.

Thus, the printer 1 according to the embodiment achieves ideal printing positions through calibration that corrects offset between printing positions, which is caused by relative tilt offset. Hence, the printer 1 can prevent a decline in image quality caused by offset in printing positions during bi-directional recording.

Here, a tilt calibration value can easily be obtained by finding a value indicating the relative tilt offset based on the adjustment patterns FPa and RPa printed using the nozzle 191*a* and the adjustment patterns FPb and RPb printed using the nozzle 191*b* (see FIG. 6).

The printer 1 according to the embodiment also accounts for conveyance offset based on a reference conveying direction. Hence, the printer 1 can prevent a decline in image quality caused by conveyance offset.

Here, a value indicating the amount of conveyance offset (conveying distance calibration value) is obtained based on the adjustment patterns FPd printed using the nozzle 191*b* and the adjustment pattern FPc printed using the nozzle 191*a* (see FIG. 8). Accordingly, a conveying distance calibration value can easily be obtained.

Further, since the printer 1 accounts for positional offset, the printer 1 can achieve ideal printing positions by calibrating the printing position for reverse prints relative to the printing positions for forward prints, thereby preventing a decline in image quality.

The initial printing direction (i.e., forward or reverse direction) in an overlap print is set to the direction for which the nozzle 191*b* is positioned upstream in the paper-conveying direction B. Accordingly, the printer 1 can perform overlap printing without having to convey the recording paper in the direction opposite the paper-conveying direction B.

While the invention has been described in detail with reference to the embodiment thereof, it would be apparent to those skilled in the art that various changes and modifications may be made therein without departing from the spirit of the invention.

For example, the printer 1 according to the embodiment described above calibrates the printing position for a forward print based on the tilt calibration value but does not calibrate the printing position for a forward print based on the tilt calibration value. However, the printer 1 may be configured to calibrate the printing position for a reverse print rather than a reverse print based on the tilt calibration value.

Further, when calibrating the printing position for a reverse print rather than a forward print based on the tilt calibration value, the printer 1 may be configured to produce adjustment patterns such as those shown in FIG. 8 using reverse prints rather than forward prints.

In the embodiment described above, the printer 1 stores the tilt calibration value acquired in S26 of the process in FIG. 5(*b*) in the tilt calibration value memory area 5*a*, but the printer 1 may instead store, in the tilt calibration value memory area 5*a*, values that can be used to calculate the tilt calibration value, such as values inputted in S21 and S22 of the same process and the tilt adjustment value acquired in S25. In this case, in S61 of FIG. 9 and in S78 and S83 of FIG. 11, the tilt calibration value is calculated based on values stored in the tilt calibration value memory area 5*a*.

Similarly, rather than using the reference conveying distance calibration value memory area 5*b* to store the conveying distance calibration value calculated in S42 of the process in FIG. 7(*b*), the reference conveying distance calibration value memory area 5*b* may be used to store a value from which the conveying distance calibration value can be calculated, such as a value inputted in S41 of the same process. In this case, in S54 of FIG. 9 and in S94 of FIG. 12, the conveying distance calibration value is calculated based on the value stored in the reference conveying distance calibration value memory area 5*b*.

Similarly, rather than using the positional offset calibration value memory area 5*c* to store the positional offset calibration value calibrated in S23 of the process in FIG. 5(*b*), the positional offset calibration value memory area 5*c* may be used to store a value from which the positional offset calibration value can be calculated, such as a value inputted in S22 of the same process. In this case, in S61 of FIG. 9 and S96 of FIG. 12, the positional offset calibration value is calculated based on the value stored in the positional offset calibration value memory area 5*c*.

In the embodiment described above, the nozzle 191*b* is used to print the adjustment patterns FPb and RPb (see FIG. 6) from which the positional offset calibration value can be obtained. However, another nozzle, such as a center nozzle in a row of nozzles extending in the paper-conveying direction B or the nozzle 191*a*, may be used to form adjustment patterns from which a positional offset calibration value can be obtained through a process similar to that described in FIG. 5(*a*).

Similarly, while the nozzles 191*a* and 191*b* are used to acquire the tilt calibration value in the embodiment, any two nozzles aligned in the paper-conveying direction B may be used to form adjustment patterns from which the tilt adjustment value can be obtained through a process similar to that described in FIG. 5(*a*).

Similarly, while the nozzles 191*a* and 191*b* are used to acquire the conveying distance calibration value in the embodiment, any two nozzles aligned in the paper-conveying direction B may be used to form adjustment patterns from which the conveying distance adjustment value can be obtained in a process similar to that described in FIG. 7(*a*).

In the adjustment pattern printing process of FIG. 5(*a*), the printer 1 is configured to print the adjustment pattern FPa or FPb in a forward print in one line and to print the adjustment patterns RPa1-RPa5 or RPb1-RPb5 in reverse prints for sequential lines. However, the printer 1 may conversely be configured to print an adjustment pattern in a reverse print in one line and to print multiple adjustment patterns in forward prints for sequential lines.

In conveying distance adjustment pattern printing process of FIG. 7(*a*), the nozzle 191*a* is configured to print the adjustment pattern FPc in one line and the nozzle 191*b* is configured to print the adjustment patterns FPd1-FPd5 for sequential lines. However, the nozzle 191*b* may conversely be configured to print an adjustment pattern in one line and the nozzle 191*a* may be configured to print multiple adjustment patterns sequential lines.

The printing process in FIG. 9 is described under the assumption that the predicted conveying distance does not differ from the actual conveying distance. However, the printer 1 may be configured to calibrate the next printing position according to a conveying distance calibration value in S58 and S64.

The printer 1 according to the embodiment calibrates positional offset resulting from relative tilt offset using a tilt calibration value obtained with the nozzles 191*a* and 191*b*. However, the head tilt during a forward print and the head tilt during a reverse print may be obtained as an image using imaging means, and the printer 1 may be configured to calculate a tilt calibration value and a positional offset calibration value based on this image.

When performing overlap printing, in S93 of the overlap printing process according to the embodiment described with reference to FIG. 12, the printer 1 sets the conveying distance applied to forward prints to {(number of nozzles N aligned in the sub-scanning direction)×(nozzle pitch R)+(conveying distance calibration value β stored in the reference conveying distance calibration value memory area 5*b*)}. However, the (number of nozzles N aligned in the sub-scanning direction)×(nozzle pitch R) may be replaced with a shorter one of the length of the printing region in the paper-conveying direction B printed in a forward print and the length of the printing region in the paper-conveying direction B printed in a reverse print. In this case, the printer 1 determines which printing direction corresponds to a printing region having a shorter length in the paper-conveying direction B and finds the length of the printing region in the paper-conveying direction B for this printing direction.

What is claimed is:

1. An image forming device comprising:

a print head formed with a plurality of print elements for forming an image on a recording medium, the print elements including a downstream element and an upstream element positioned upstream of the downstream element in a conveying direction;

a head moving mechanism for reciprocatingly moving the print head in a first direction and a second direction opposite to the first direction, wherein both the first direction and the second direction are orthogonal to the conveying direction, and the print head performs a bi-directional printing including a first print for forming a first image while being moved in the first direction and a second print for forming a second image while being moved in the second direction;

a conveying mechanism that conveys the recording medium toward a downstream side in the conveying direction relative to the print head;

a first memory that stores one of a positional offset amount and a positional offset calibration value, the positional offset amount indicating an offset between a first printing position when performing the first print and a second printing position when performing the second print, the positional offset calibration value being determined based on the positional offset amount;

a determining unit that determines one of the first printing position and the second printing position that is located upstream in the conveying direction by referring to the one of the positional offset amount and the positional offset calibration value, in the case where performing an overlap print that overlaps images by the first print and the second print, wherein in the case where performing the overlap print, the conveying mechanism conveys the recording medium to a first position that is determined based on a predetermined distance prior to the first print and to a second position that is determined based on the predetermined distance and the one of the positional offset amount and the positional offset calibration value prior to the second print, wherein in the case where performing the overlap print, the first print is performed prior to the second print when the determining unit determines that the first printing position is located upstream of the second printing position, whereas the second print is performed prior to the first print when the determining unit determines that the second printing position is located upstream of the first printing position.

2. The image forming device according to claim 1, wherein the conveying mechanism conveys the recording medium toward the downstream side in the conveying direction relative to the print head a first amount prior to the first print and a second amount prior to the second print, the image forming device further comprising a second memory that stores one of a relative tilt offset amount and a tilt calibration value, the relative tilt offset amount indicating an offset between tilt of the print head relative to the conveying direction when the head moving mechanism conveys the print head in the first direction and tilt of the print head relative to the conveying direction when the head moving mechanism moves the print head in the second direction, the tilt calibration value being determined based on the relative tilt offset amount; and a conveying amount setting unit that sets the first amount to a calibrated amount that is obtained by calibrating a prescribed amount based on the one of the relative tilt offset amount and the relative tilt calibration value prior to the first print and that sets the second amount to the prescribed amount prior to the second print.

3. The image forming device according to claim 2, wherein the relative tilt offset amount is obtained by subtracting a first value from a second value, the first value being a length in the conveying direction between a position of an image formed by the upstream element during the first print and a position of an image formed by the upstream element during the second print, the second value being a length in the conveying direction between a position of an image formed by the downstream element during the first print and a position of an image formed by the downstream element during the second print.

4. The image forming device according to claim 2, wherein the relative tilt offset amount is obtained by subtracting a first value from a second value, the first value being a length in the conveying direction between a position of an image formed by the upstream element during the first print and a position of an image formed by the downstream element during the first print, the second value being a length in the conveying direction between a position of an image formed by the upstream element during the second print and a position of an image formed by the downstream element during the second print.

5. The image forming device according to claim 2, further comprising:

a third memory that stores a current position of the recording medium;

a next position setting unit that sets a next printing position of the recording medium based on the current position, a predetermined distance, and the one of the relative tilt offset amount and the relative tilt offset calibration value prior to the first print and immediately after the second print, and that sets a next printing position of the recording medium based on the current position and the predetermined distance prior to the second print and immediately after the first print; and wherein the conveying amount setting unit sets the first and second amounts based on difference between the current position and the next printing position.

6. The image forming device according to claim 2, further comprising a fourth memory that stores one of a conveyance offset amount and a conveyance offset calibration value, the conveyance offset amount indicating an offset between a predicted amount that the conveying mechanism is predicted to convey the recording medium and an actual amount that the conveying mechanism actually conveys the recording medium, the conveyance offset calibration value being determined based on the conveyance offset amount, wherein the conveying amount setting unit calibrates the first and second amounts based on the one of the conveyance offset amount and the conveyance offset calibration value.

7. The image forming device according to claim 2, further comprising a positional offset calibration unit that calibrates the first amount and the second amount based on the one of the positional offset amount and the positional offset calibration value.

8. A method for controlling an image forming device including: a print head formed with a plurality of print elements for forming an image on a recording medium, the print head performing a bi-directional printing including a first print for forming a first image while being moved in a first direction and a second print for forming a second image while being moved in a second direction opposite to the first direction; and a first memory that stores one of a positional offset amount and a positional offset calibration value, the positional offset amount indicating an offset between a first printing position when performing the first print and a second printing position when performing the second print, the positional offset calibration value being determined based on the positional offset amount, the method comprising:

determining one of the first printing position and the second printing position that is located upstream in a conveying direction by referring to the one of the positional offset amount and the positional offset calibration value, the conveying direction being orthogonal to the first and second directions;

performing an overlap print that overlaps images by the first print and the second print; the overlap print including:

conveying the recording medium to a first position that is determined based on a predetermined distance prior to the first print; and conveying the recording medium to a second position that is determined based on the predetermined distance and the one of the positional offset amount and the positional offset calibration value prior to the second print, wherein in the case where performing the overlap print, the first print is performed prior to the second print when the determining determines that the first printing position is located upstream of the second printing position, whereas the second print is performed prior to the first print when the determining determines that the second printing position is located upstream of the first printing position.

9. A storage medium storing a set of program instructions executable on a data processing device and usable for controlling an image forming device including: a print head formed with a plurality of print elements for forming an image on a recording medium, the print head performing a bi-directional printing including a first print for forming a first image while being moved in a first direction and a second print for forming a second image while being moved in a second direction opposite to the first direction; and a first memory that stores one of a positional offset amount and a positional offset calibration value, the positional offset amount indicating an offset between a first printing position when performing the first print and a second printing position when performing the second print, the positional offset calibration value being determined based on the positional offset amount, the program instructions comprising:

determining one of the first printing position and the second printing position that is located upstream in a conveying direction by referring to the one of the positional offset amount and the positional offset calibration value, the conveying direction being orthogonal to the first and second directions;

performing an overlap print that overlaps images by the first print and the second print; the overlap print including:

conveying the recording medium to a first position that is determined based on a predetermined distance prior to the first print; and conveying the recording medium to a second position that is determined based on the predetermined distance and the one of the positional offset amount and the positional offset calibration value prior to the second print, wherein in the case where performing the overlap print, the first print is performed prior to the second print when the determining determines that the first printing position is located upstream of the second printing position, whereas the second print is performed prior to the first print when the determining determines that the second printing position is located upstream of the first printing position.

* * * * *